US011358404B2

(12) United States Patent
Kuwayama et al.

(10) Patent No.: US 11,358,404 B2
(45) Date of Patent: Jun. 14, 2022

(54) PRINTER AND METHOD FOR PREVENTING ERRONEOUS INTERRUPTION OF PRINTING

(71) Applicant: Brother Kogyo Kabushiki Kaisha, Nagoya (JP)

(72) Inventors: Tsuyoshi Kuwayama, Kasugai (JP); Satoru Arakane, Nagoya (JP); Kenji Kawamoto, Nagoya (JP); Shoji Sato, Okazaki (JP); Shoko Ota, Okazaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/556,650

(22) Filed: Aug. 30, 2019

(65) Prior Publication Data

US 2020/0070552 A1 Mar. 5, 2020

(30) Foreign Application Priority Data

Aug. 30, 2018 (JP) ..... JP2018-161895

(51) Int. Cl.
*B41J 2/165* (2006.01)
*B41J 19/20* (2006.01)
*B41J 11/00* (2006.01)

(52) U.S. Cl.
CPC ..... *B41J 19/207* (2013.01); *B41J 2/16508* (2013.01); *B41J 2/16526* (2013.01); *B41J 11/006* (2013.01)

(58) Field of Classification Search
None
See application file for complete search history.

(56) References Cited

U.S. PATENT DOCUMENTS 7,448,721 B2 * 11/2008 Oshio ..... B41J 2/16526 347/23
7,862,145 B2 * 1/2011 Umezawa ..... B41J 2/0458 347/23

(Continued)

FOREIGN PATENT DOCUMENTS

JP 2010-184443 A 8/2010
JP 5032909 B2 9/2012

(Continued)

*Primary Examiner* — Alejandro Valencia
(74) *Attorney, Agent, or Firm* — Banner & Witcoff, Ltd.

(57) ABSTRACT

A printer includes a head having nozzles, a carriage with the head mounted thereon, a carriage motor to move the carriage along a scanning direction, an encoder including a scale having reference marks formed thereon along a particular direction, and a sensor to detect the reference marks while moving relative to the scale along with movement of the carriage along the scanning direction, and a controller configured to perform liquid discharging to control the head to discharge liquid from the nozzles toward a recording medium while performing feedback control of the carriage motor based on velocity information such that the carriage moves at a target velocity along the scanning direction, the velocity information representing a carriage velocity based on detection results of the sensor, and interrupt the liquid discharging when the carriage velocity exceeds an overshoot threshold higher than the target velocity during the liquid discharging.

10 Claims, 13 Drawing Sheets

(56) References Cited

U.S. PATENT DOCUMENTS

| | | | | |
|---|---|---|---|---|
| 2003/0067507 | A1* | 4/2003 | Anzai | B41J 19/202 347/37 |
| 2009/0237744 | A1 | 9/2009 | Ogura et al. | |
| 2012/0026217 | A1* | 2/2012 | Anzai | B41J 19/202 347/5 |
| 2017/0232746 | A1 | 8/2017 | Nishida | |

FOREIGN PATENT DOCUMENTS

| | | | |
|---|---|---|---|
| JP | 2016-137674 | A | 8/2016 |
| JP | 2017-144726 | A | 8/2017 |

* cited by examiner

PRINTER AND METHOD FOR PREVENTING ERRONEOUS INTERRUPTION OF PRINTING

CROSS-REFERENCE TO RELATED APPLICATION

This application claims priority under 35 U.S.C. § 119 from Japanese Patent Application No. 2018-161895 filed on Aug. 30, 2018. The entire subject matter of the application is incorporated herein by reference.

BACKGROUND

Technical Field

Aspects of the present disclosure are related to a printer and a method for preventing erroneous interruption of printing.

Related Art

Heretofore, as an example of the printer, a serial-type inkjet printer has been known that is configured to discharge ink from a head while moving a carriage with the head mounted thereon along a scanning direction. The known inkjet printer is further configured to perform feedback control of a driving motor for the carriage in such a manner that the driving motor is supplied with an electric current adjusted based on a deviation of a velocity of the carriage detected using a linear encoder from a target velocity of the carriage.

In general, inkjet printers have a potential problem that during the movement of the carriage, the head might come into contact with and rub against a sheet cockled or curled after absorbing ink discharged from the head. Then, when the carriage is further moved even after the head has come to rub against the sheet, the head and the sheet are alternately and repeatedly brought into contact and non-contact with each other. Thereby, the head might be damaged.

To solve the above problem, the known inkjet printer stops the carriage and interrupts a printing process, based on a determination that the head is rubbing against the sheet, when the value of the electric current applied to the driving motor is higher than a particular threshold. The determination is based on the following characteristic event in the feedback control of the carriage motor. That is, the value of the electric current applied to the driving motor under the feedback control is more than a normal current value, when the detected velocity of the carriage is lower than the target velocity due to rubbing between the head and the sheet.

SUMMARY

In general, the linear encoder for detecting the velocity of the carriage includes a scale having reference marks formed thereon at regular intervals along the scanning direction, and a sensor for detecting the reference marks formed on the scale. The linear encoder is configured to read the reference marks on the scale by the sensor during the movement of the carriage, thereby detecting the velocity of the carriage. In the linear encoder configured as above, if the scale is stained or flawed, the sensor might not accurately read the reference marks on the scale. Consequently, the velocity of the carriage detected using the linear encoder might be lower than an actual velocity of the carriage. When the same trouble occurs in the known inkjet printer such that the velocity of the carriage detected using the linear encoder is lower than the target velocity due to the scale stained or flawed, the known inkjet printer might unnecessarily interrupt the printing process based on an erroneous determination that the head is rubbing against the sheet.

Further, the inkjet printer may employ a rotary encoder instead of the linear encoder. In general, the rotary encoder is connected with a shaft of the driving motor. The rotary encoder includes a disk-shaped scale having reference marks formed thereon at regular intervals in a circumferential direction, and a sensor for detecting the reference marks formed on the scale. The rotary encoder is configured to read, by the sensor, the reference marks on the scale rotating during the movement of the carriage, thereby detecting the velocity of the carriage. In substantially the same manner as the aforementioned problem with the linear encoder, if the scale of the rotary encoder is stained or flawed, the sensor might not accurately read the reference marks on the scale. Consequently, the inkjet printer might unnecessarily interrupt the printing process based on an erroneous determination that the head is rubbing against the sheet, even though the head is not actually rubbing against the sheet.

Aspects of the present disclosure are advantageous to provide one or more improved techniques for a printer to prevent a head of the apparatus from being damaged due to contact between the head and a printing medium and to avoid erroneous interruption of printing.

According to aspects of the present disclosure, a printer is provided, which includes a head having nozzles configured to discharge liquid therefrom, a carriage with the head mounted thereon, a carriage motor configured to, when driven, cause the carriage to move along a scanning direction, an encoder including a scale having reference marks formed thereon, the reference marks being arranged at regular intervals along a particular direction, and a sensor configured to detect the reference marks formed on the scale while moving relative to the scale along the particular direction along with movement of the carriage along the scanning direction, and a controller. The controller is configured to perform liquid discharging to control the head to discharge the liquid from the nozzles toward a recording medium while performing feedback control of the carriage motor based on velocity information in such a manner that the carriage moves at a target velocity along the scanning direction, the velocity information representing a carriage velocity as a velocity of the carriage based on results of detecting the reference marks by the sensor, and interrupt the liquid discharging, when the carriage velocity represented by the velocity information is higher than an overshoot threshold during the liquid discharging, the overshoot threshold being higher than the target velocity.

According to aspects of the present disclosure, further provided is a printer that includes a head having nozzles configured to discharge liquid therefrom, a carriage with the head mounted thereon, a carriage motor configured to, when driven, cause the carriage to move along a scanning direction, an encoder including a scale having reference marks formed thereon, the reference marks being arranged at regular intervals along a particular direction, and a sensor configured to detect the reference marks formed on the scale while moving relative to the scale along the particular direction along with movement of the carriage along the scanning direction, a current sensor configured to detect a value of an electric current applied to the carriage motor, and a controller. The controller is configured to perform liquid discharging to control the head to discharge the liquid from the nozzles toward a recording medium while driving the carriage motor with feedback control to adjust the electric current applied to the carriage motor based on velocity information in such a manner that the carriage moves at a target velocity along the scanning direction, the velocity information representing a velocity of the carriage based on results of detecting the reference marks by the sensor, and interrupt the liquid discharging, when the detected value of the electric current applied to the carriage motor is lower than an undershoot threshold during the liquid discharging, the undershoot threshold being lower than a value of the electric current applied to the carriage motor when the carriage is moving at the target velocity.

According to aspects of the present disclosure, further provided is a method implementable on a controller of a printer. The printer includes a head having nozzles, a carriage with the head mounted thereon, a carriage motor configured to reciprocate the carriage along a scanning direction, and an encoder comprising a scale having reference marks formed thereon at regular intervals along a particular direction, and a sensor configured to detect the reference marks on the scale while moving relative to the scale along the particular direction along with movement of the carriage along the scanning direction. The method includes performing liquid discharging to control the head to discharge liquid from the nozzles toward a recording medium while performing feedback control of the carriage motor based on velocity information in such a manner that the carriage moves at a target velocity along the scanning direction, the velocity information representing a carriage velocity as a velocity of the carriage based on results of detecting the reference marks by the sensor, and interrupting the liquid discharging, when the carriage velocity represented by the velocity information is higher than an overshoot threshold during the liquid discharging, the overshoot threshold being higher than the target velocity.

BRIEF DESCRIPTION OF THE ACCOMPANYING DRAWINGS

Figure 4A:
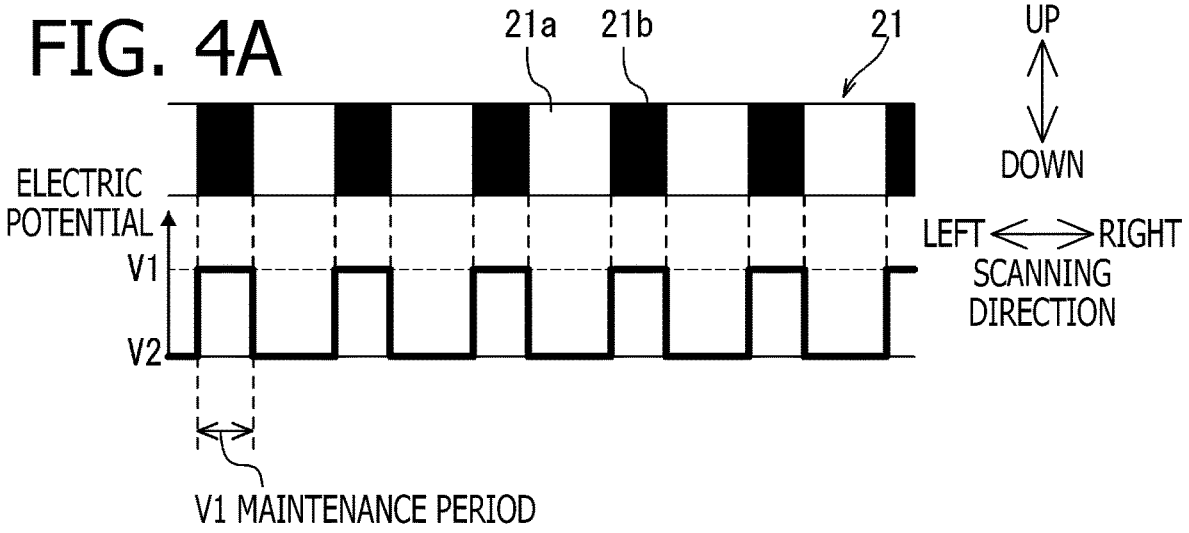
FIG. 4A shows a pulse signal output from the sensor when the scale is not stained, in the illustrative embodiment according to one or more aspects of the present disclosure.
Figure 4B:
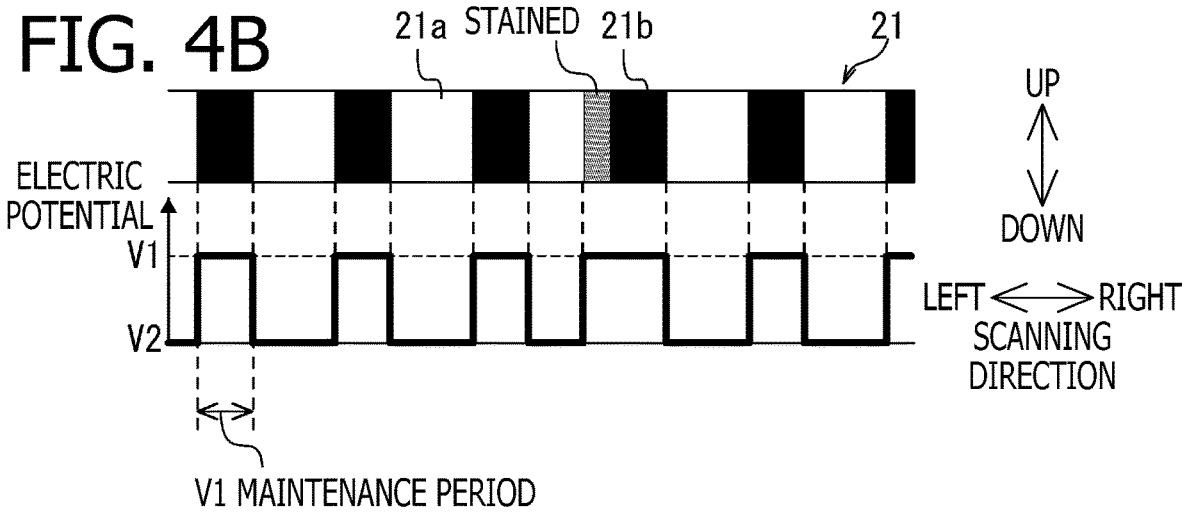
Figure 4C:
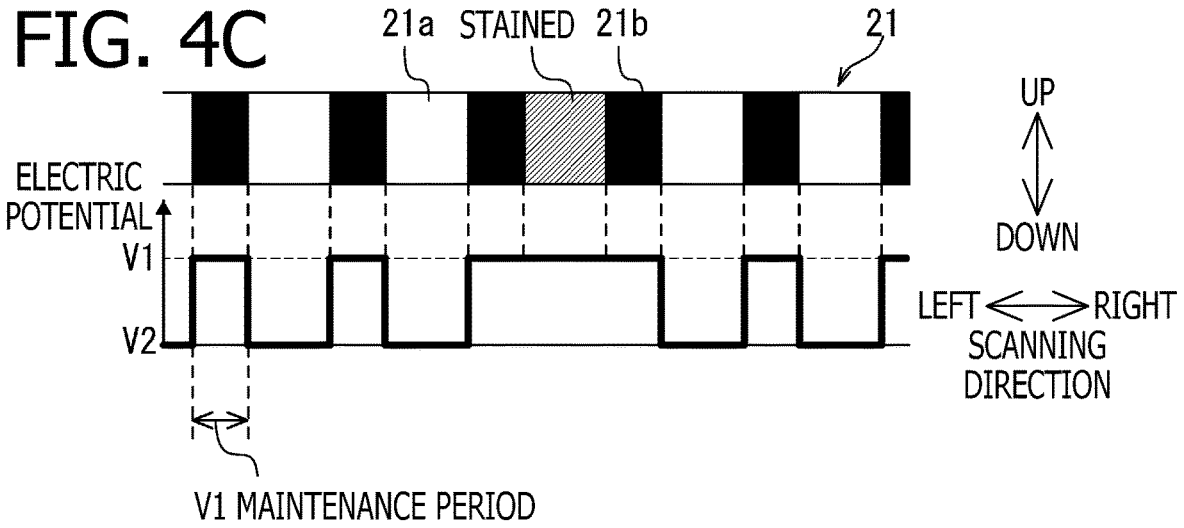

FIGS. 4B and 4C exemplify pulse signals output from the sensor when the scale is stained, in the illustrative embodiment according to one or more aspects of the present disclosure.

Figure 5:
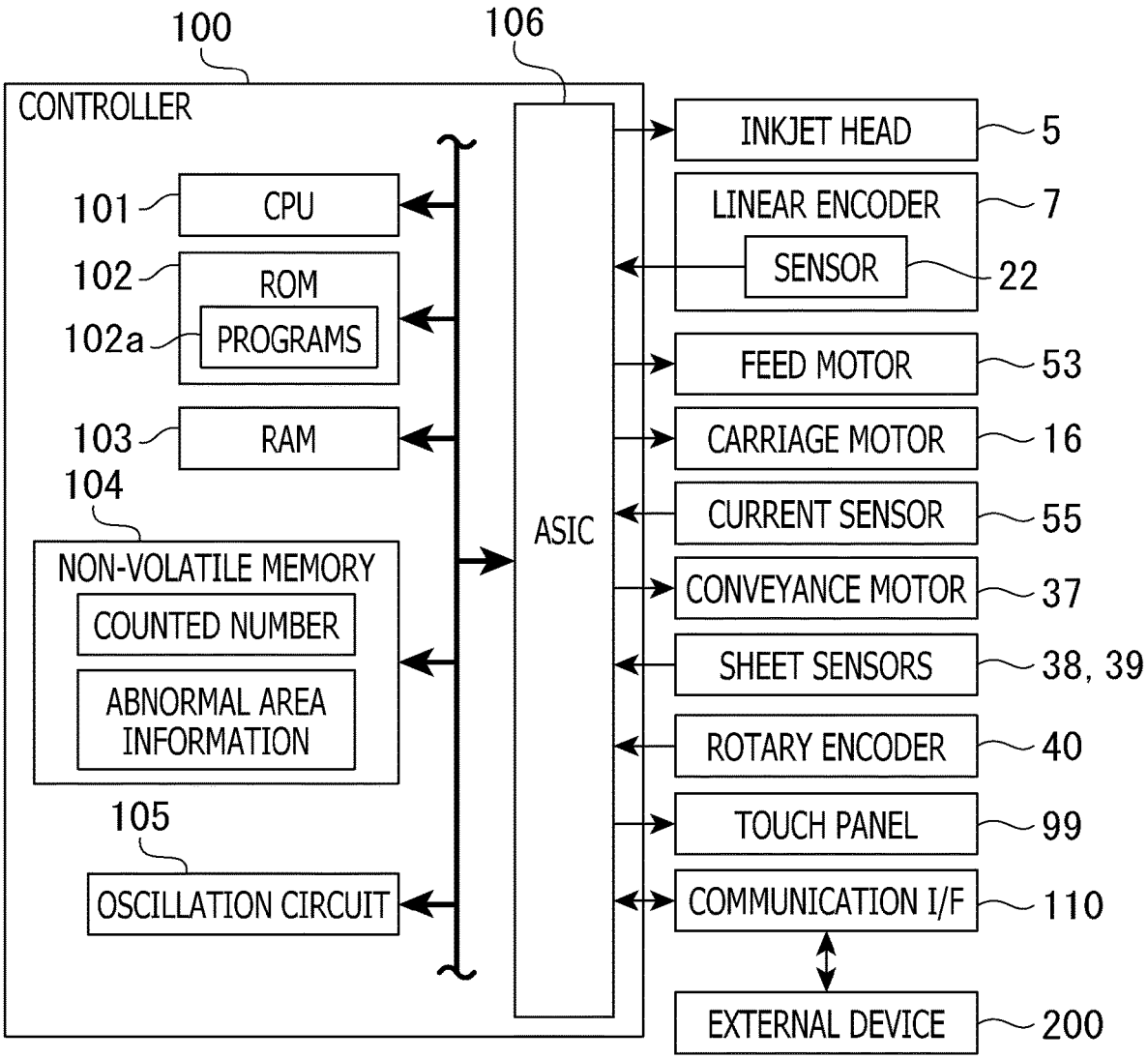

FIG. 5 is a block diagram showing an electrical configuration of the inkjet printer in the illustrative embodiment according to one or more aspects of the present disclosure.

Figure 6A:
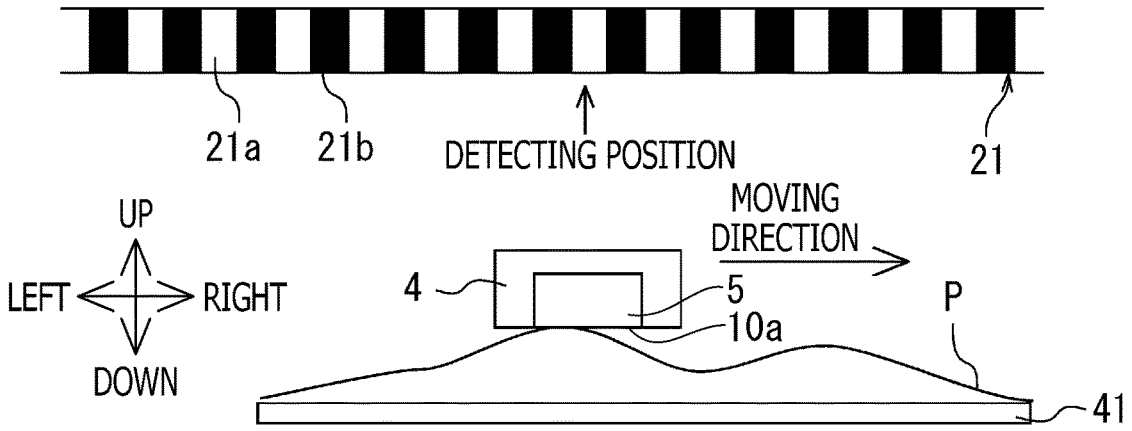

FIG. 6A shows a state where a head is rubbing against a sheet when a detecting position of the sensor is outside an abnormal area on the scale, in the illustrative embodiment according to one or more aspects of the present disclosure.

Figure 6B:
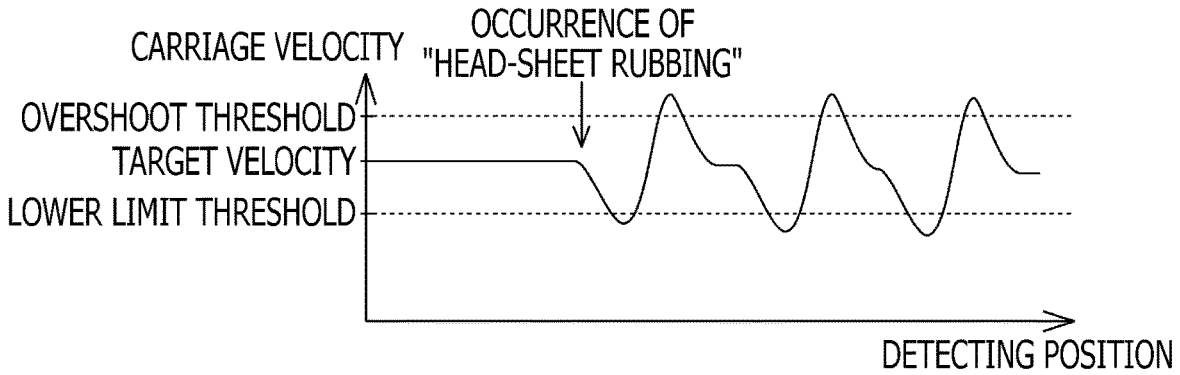

FIG. 6B shows a behavior of a carriage velocity obtained based on results of detection by the sensor in the state where the head is rubbing against the sheet when the detecting position of the sensor is outside the abnormal area on the scale, in the illustrative embodiment according to one or more aspects of the present disclosure.

Figure 6C:
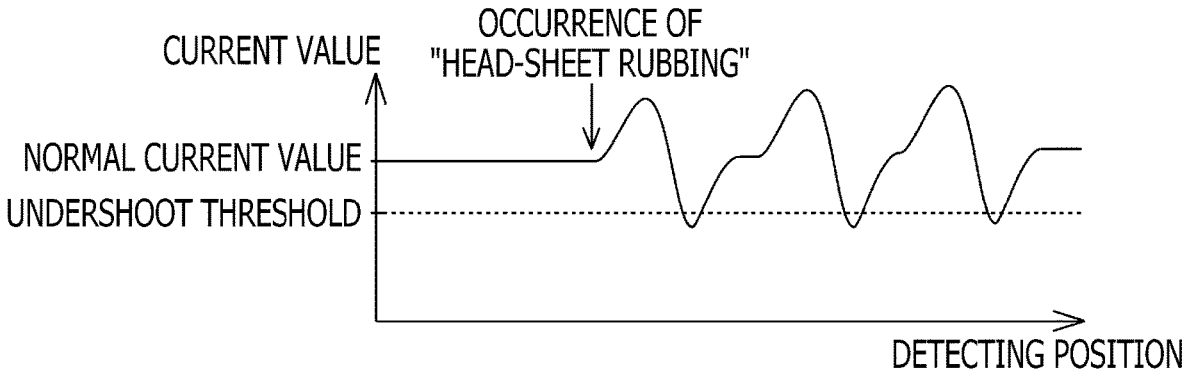

FIG. 6C shows a behavior of an electric current applied to a carriage motor in the state where the head is rubbing against the sheet when the detecting position of the sensor is outside the abnormal area on the scale, in the illustrative embodiment according to one or more aspects of the present disclosure.

Figure 7A:
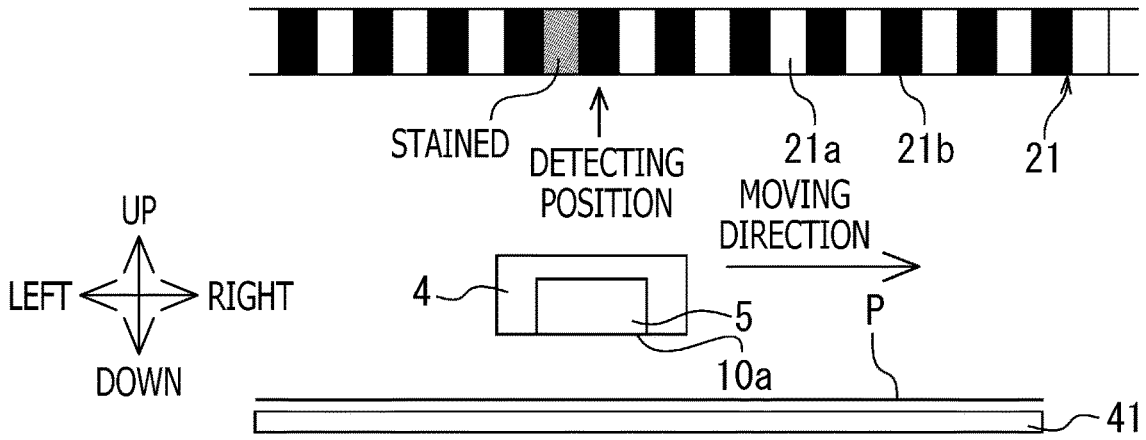

FIG. 7A shows a state where the head is not rubbing against the sheet when the detecting position of the sensor is within the abnormal area on the scale, in the illustrative embodiment according to one or more aspects of the present disclosure.

Figure 7B:
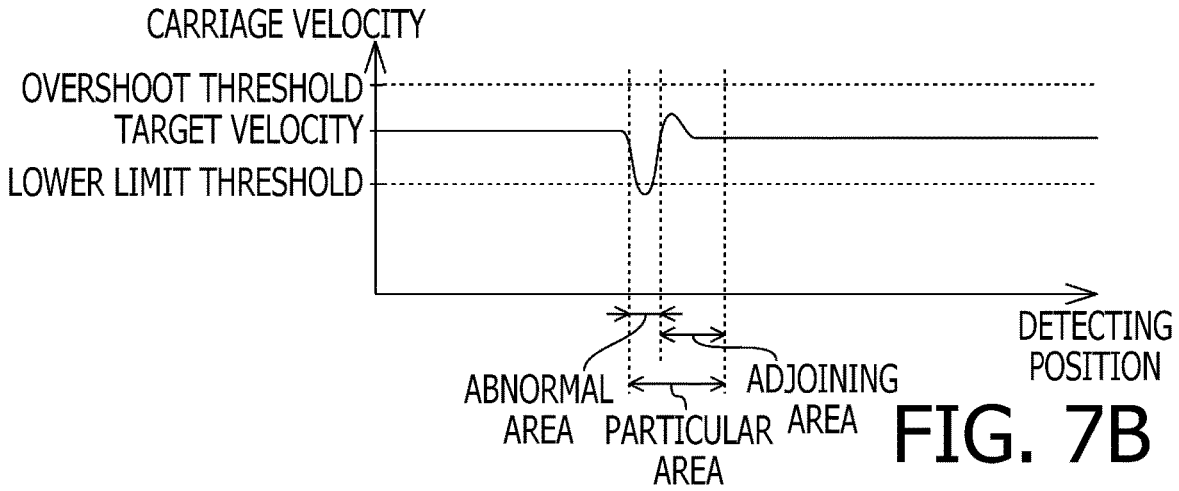

FIG. 7B shows a behavior of the carriage velocity obtained based on results of detection by the sensor in the state where the head is not rubbing against the sheet when the detecting position of the sensor is within the abnormal area on the scale, in the illustrative embodiment according to one or more aspects of the present disclosure.

Figure 7C:
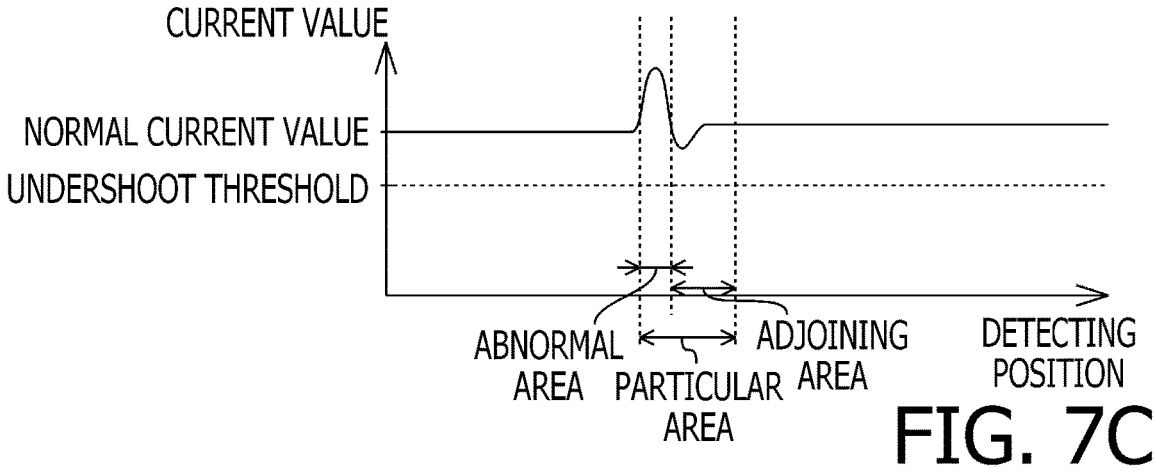

FIG. 7C shows a behavior of the electric current applied to the carriage motor in the state where the head is not rubbing against the sheet when the detecting position of the sensor is within the abnormal area on the scale, in the illustrative embodiment according to one or more aspects of the present disclosure.

Figure 8A:
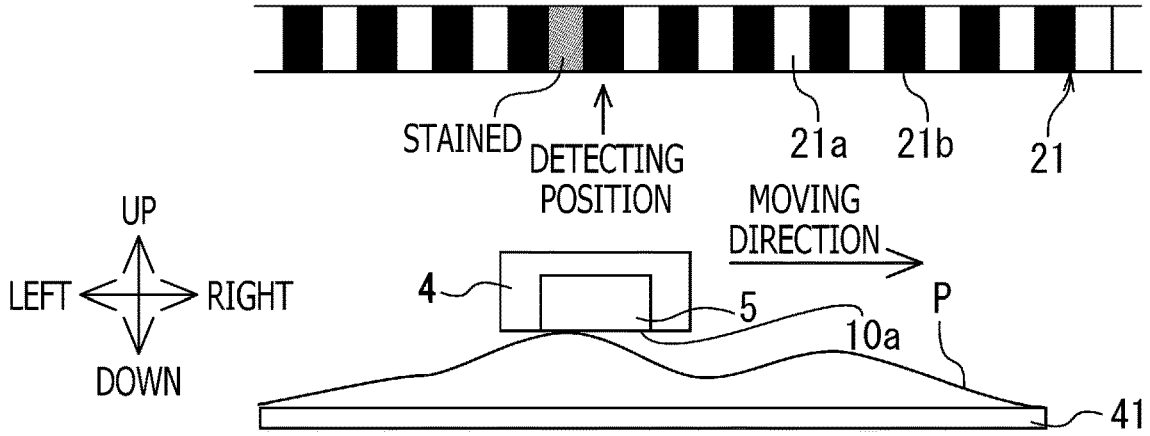

FIG. 8A shows a state where the head is rubbing against the sheet when the detecting position of the sensor is within the abnormal area on the scale, in the illustrative embodiment according to one or more aspects of the present disclosure.

Figure 8B:
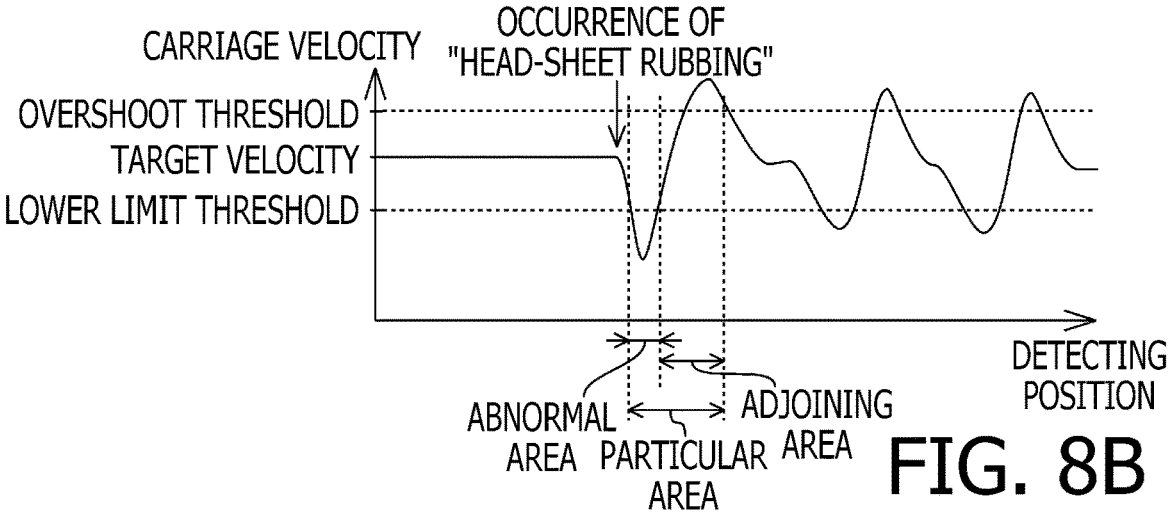

FIG. 8B shows a behavior of the carriage velocity obtained based on results of detection by the sensor in the state where the head is rubbing against the sheet when the detecting position of the sensor is within the abnormal area on the scale, in the illustrative embodiment according to one or more aspects of the present disclosure.

Figure 8C:
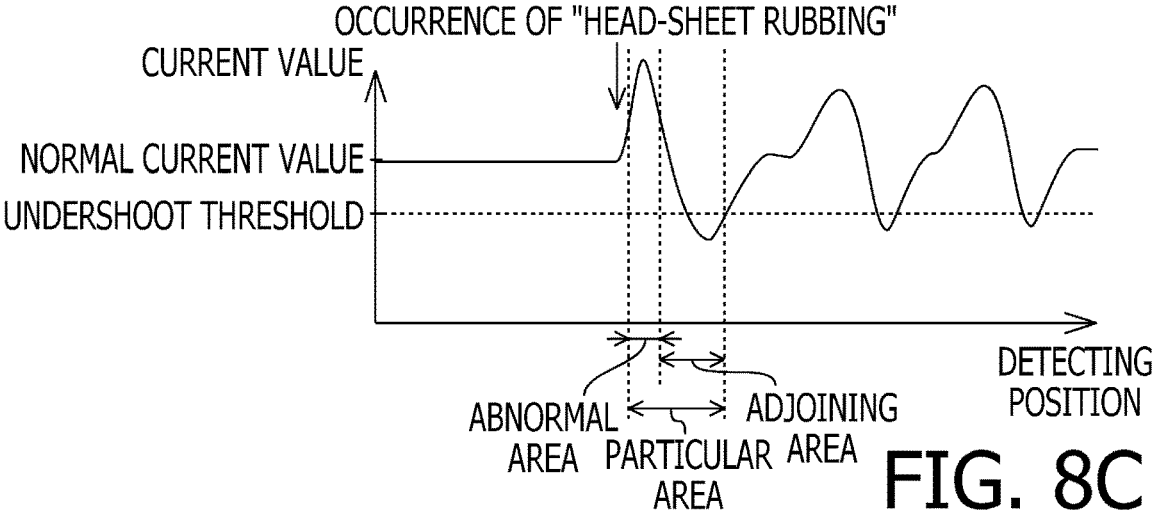

FIG. 8C shows a behavior of the electric current applied to the carriage motor in the state where the head is rubbing against the sheet when the detecting position of the sensor is within the abnormal area on the scale, in the illustrative embodiment according to one or more aspects of the present disclosure.

Figure 9A:
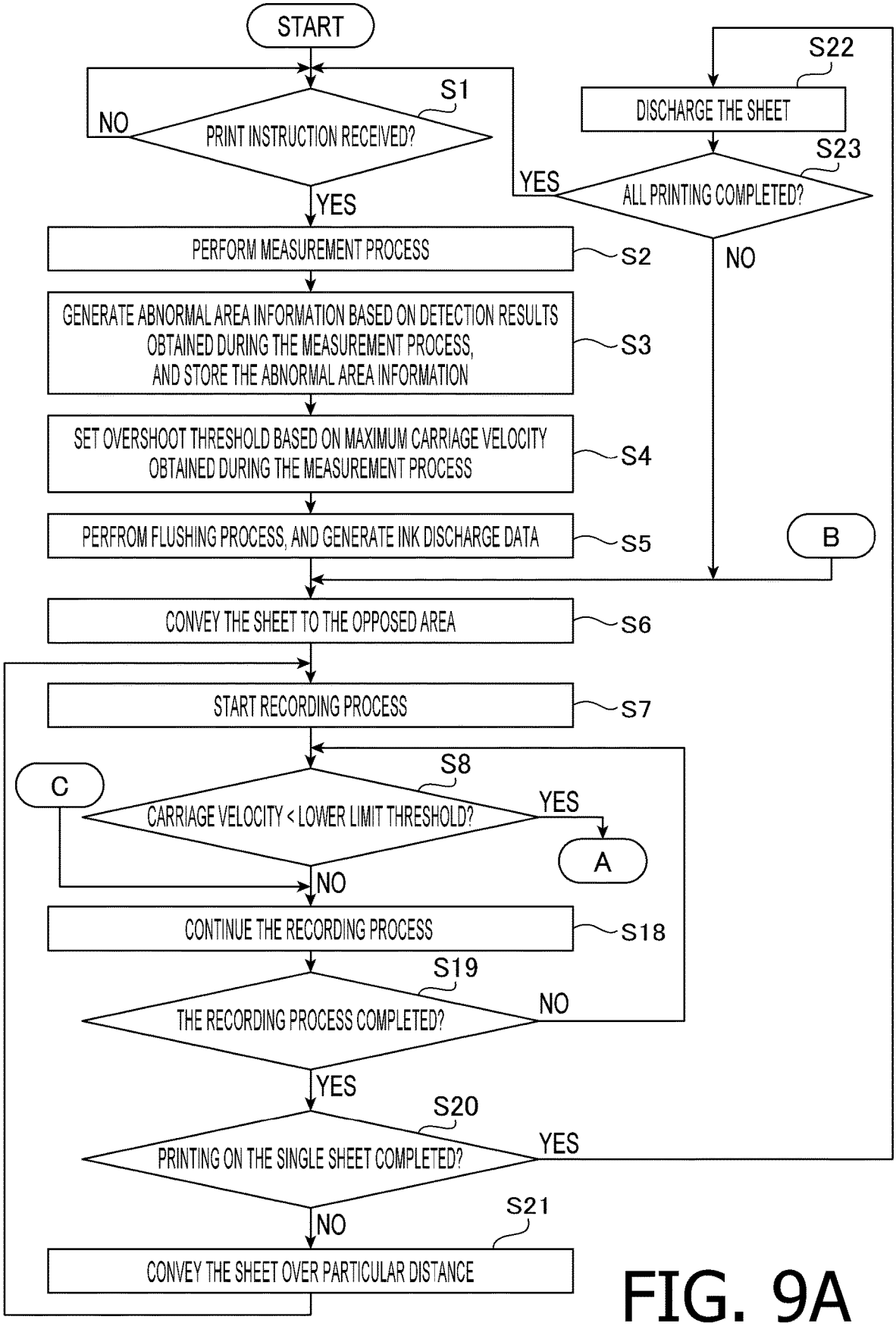
Figure 9B:
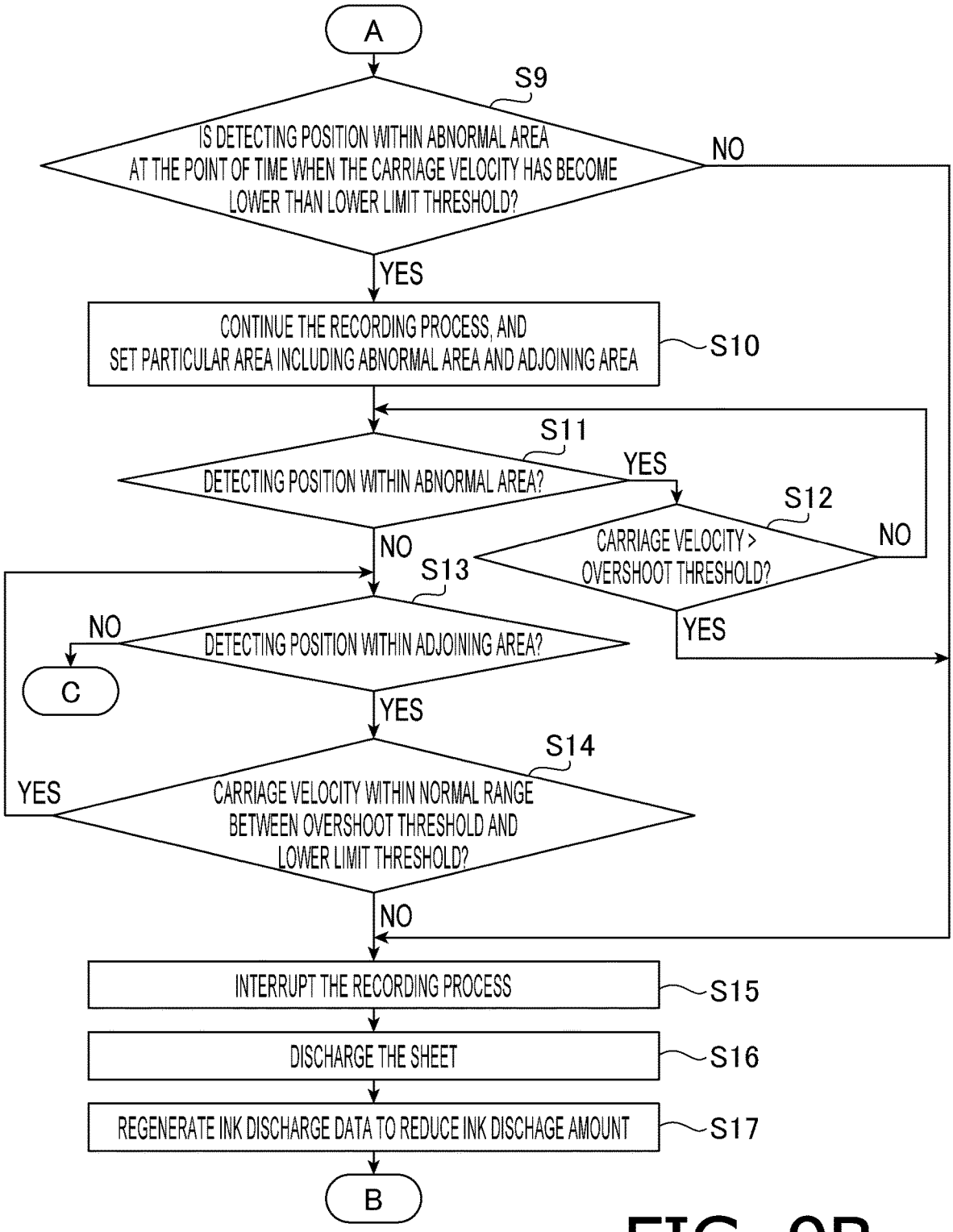

FIGS. 9A and 9B are flowcharts showing a sequence of operations by the inkjet printer in the illustrative embodiment according to one or more aspects of the present disclosure.

Figure 10A:
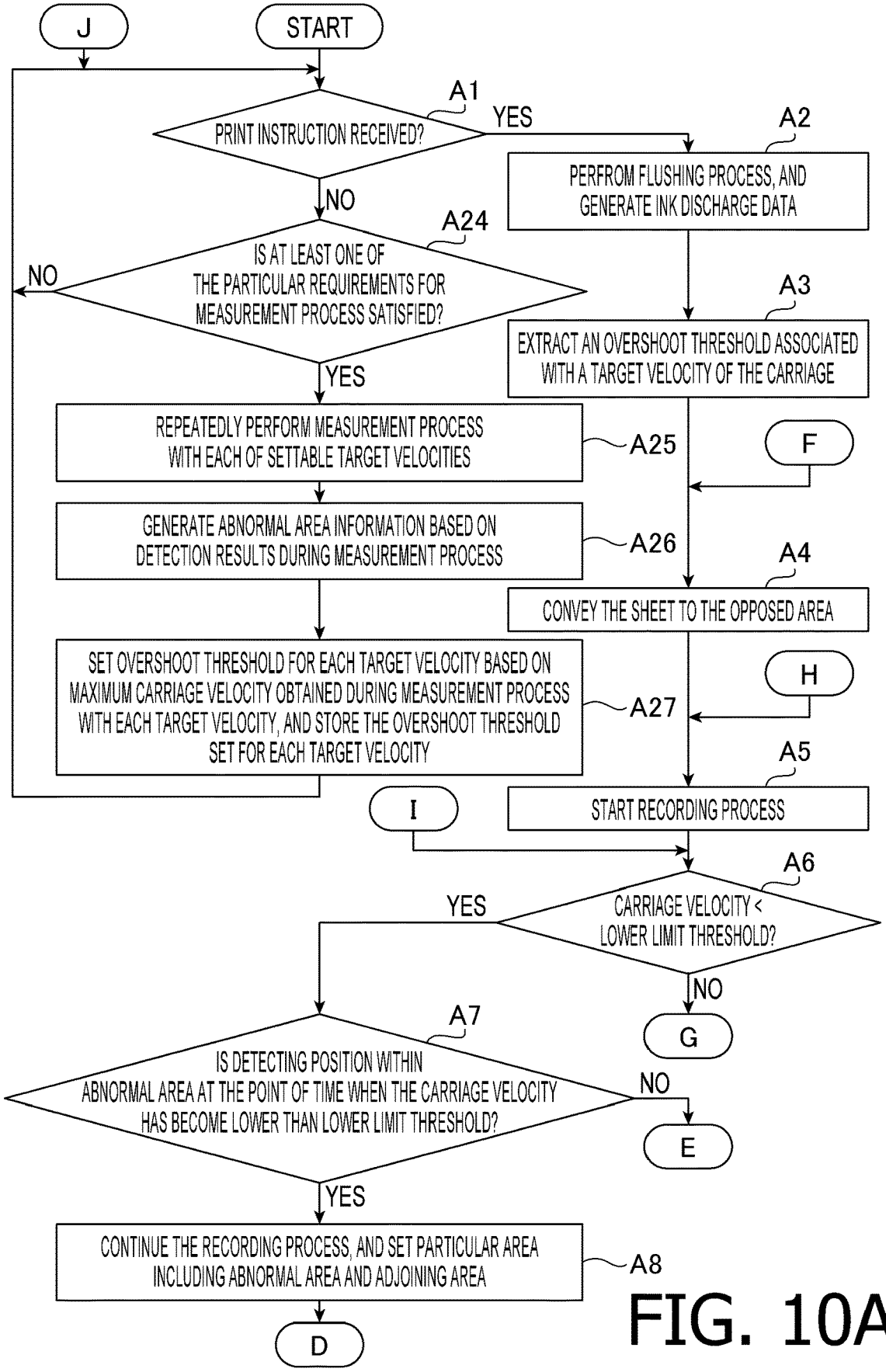
Figure 10B:
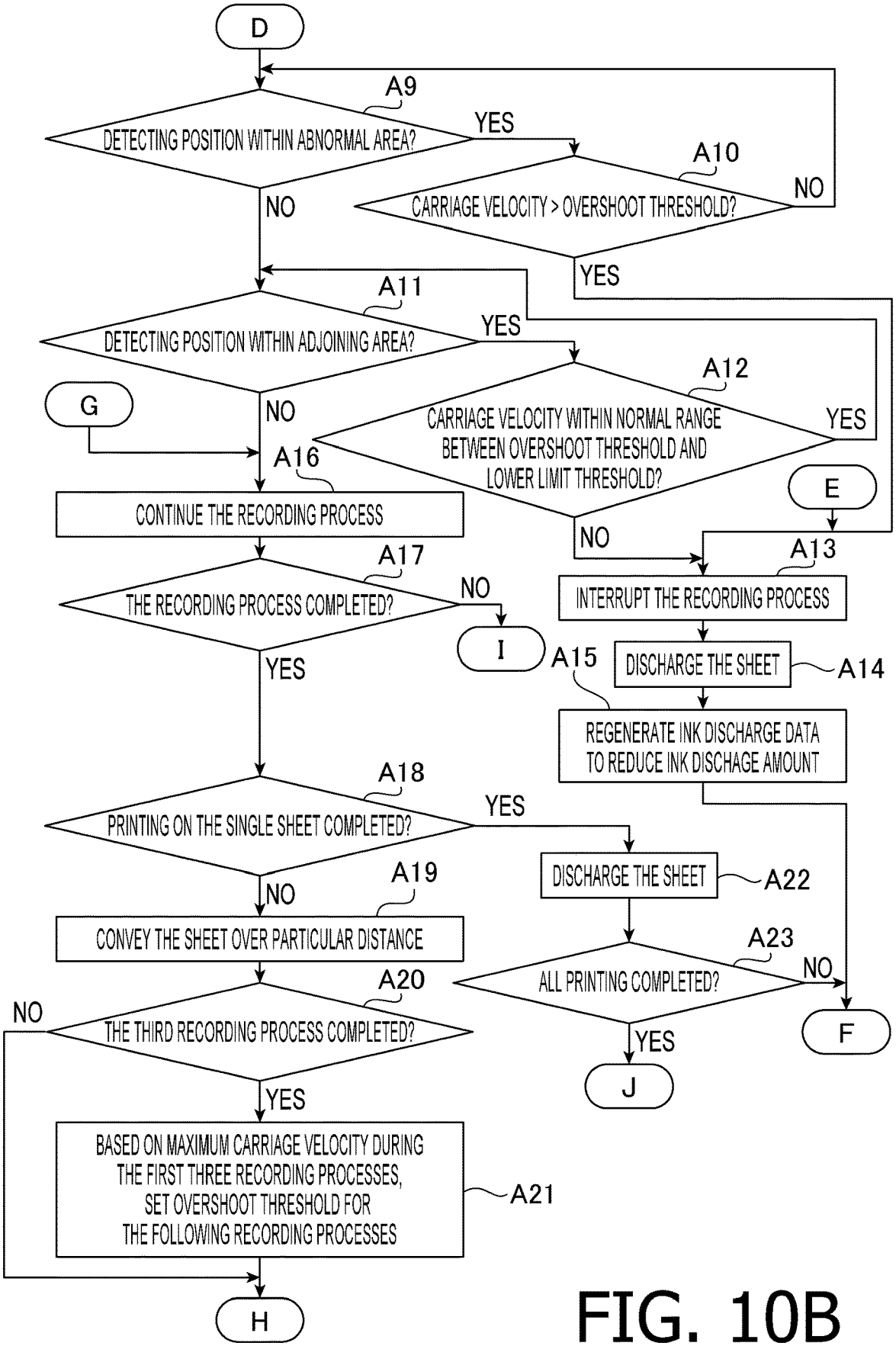

FIGS. 10A and 10B are flowcharts showing a sequence of operations by the inkjet printer in a first modification according to one or more aspects of the present disclosure.

Figure 11:
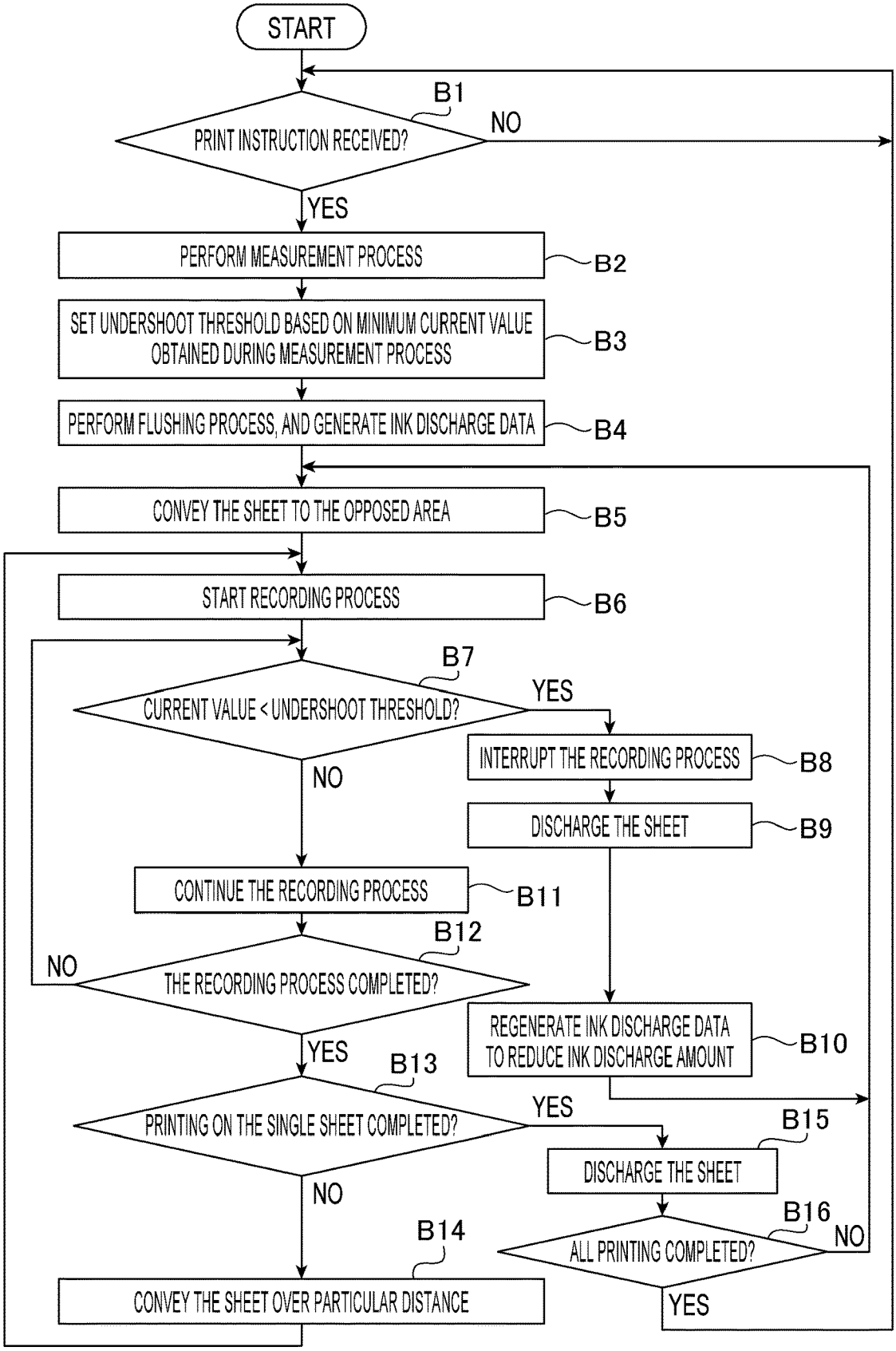

FIG. 11 is a flowchart showing a sequence of operations by the inkjet printer in a second modification according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Figure 1:
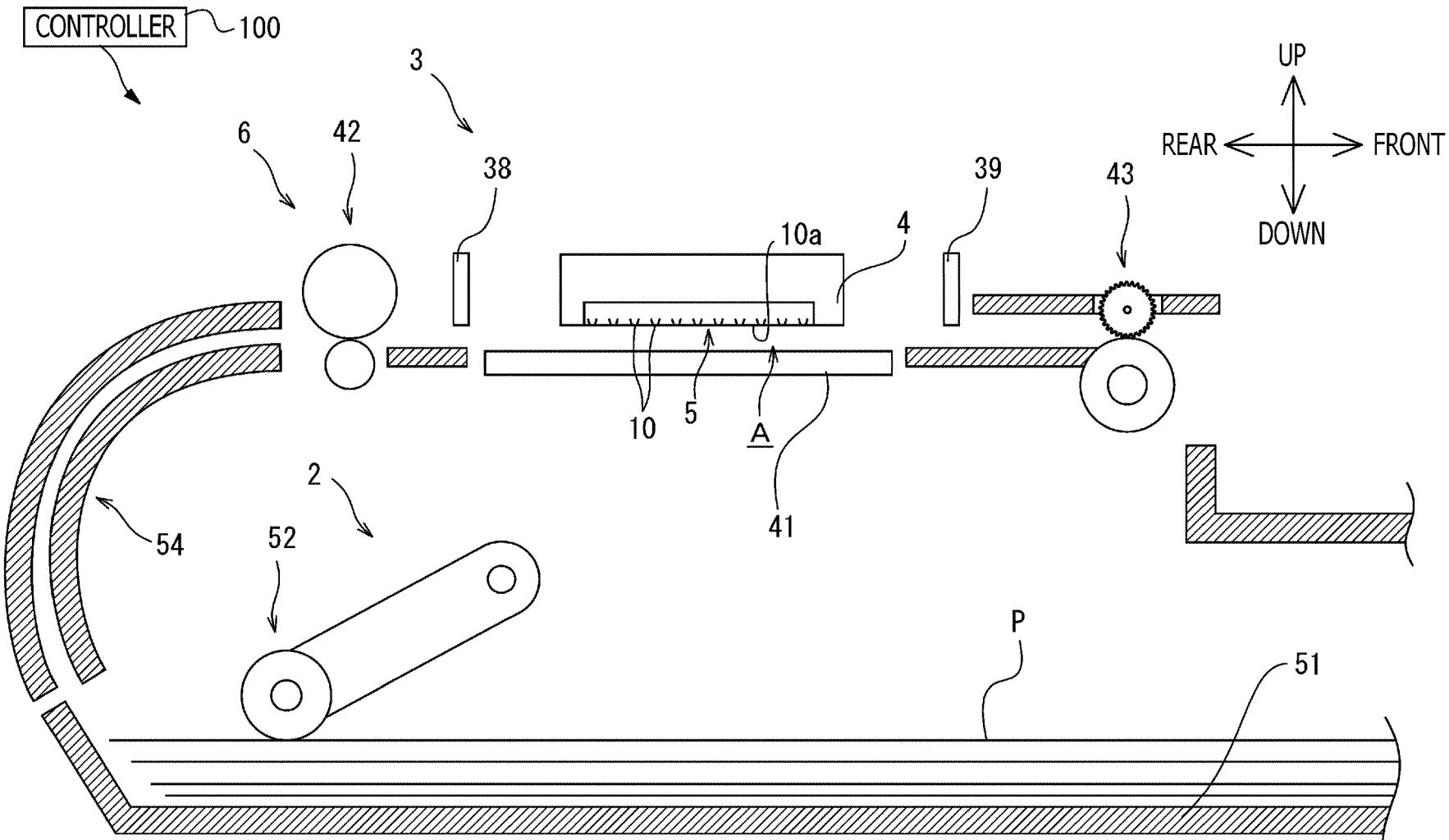
FIG. 1 is a cross-sectional side view schematically showing a configuration of an inkjet printer in an illustrative embodiment according to one or more aspects of the present disclosure.
Figure 2:
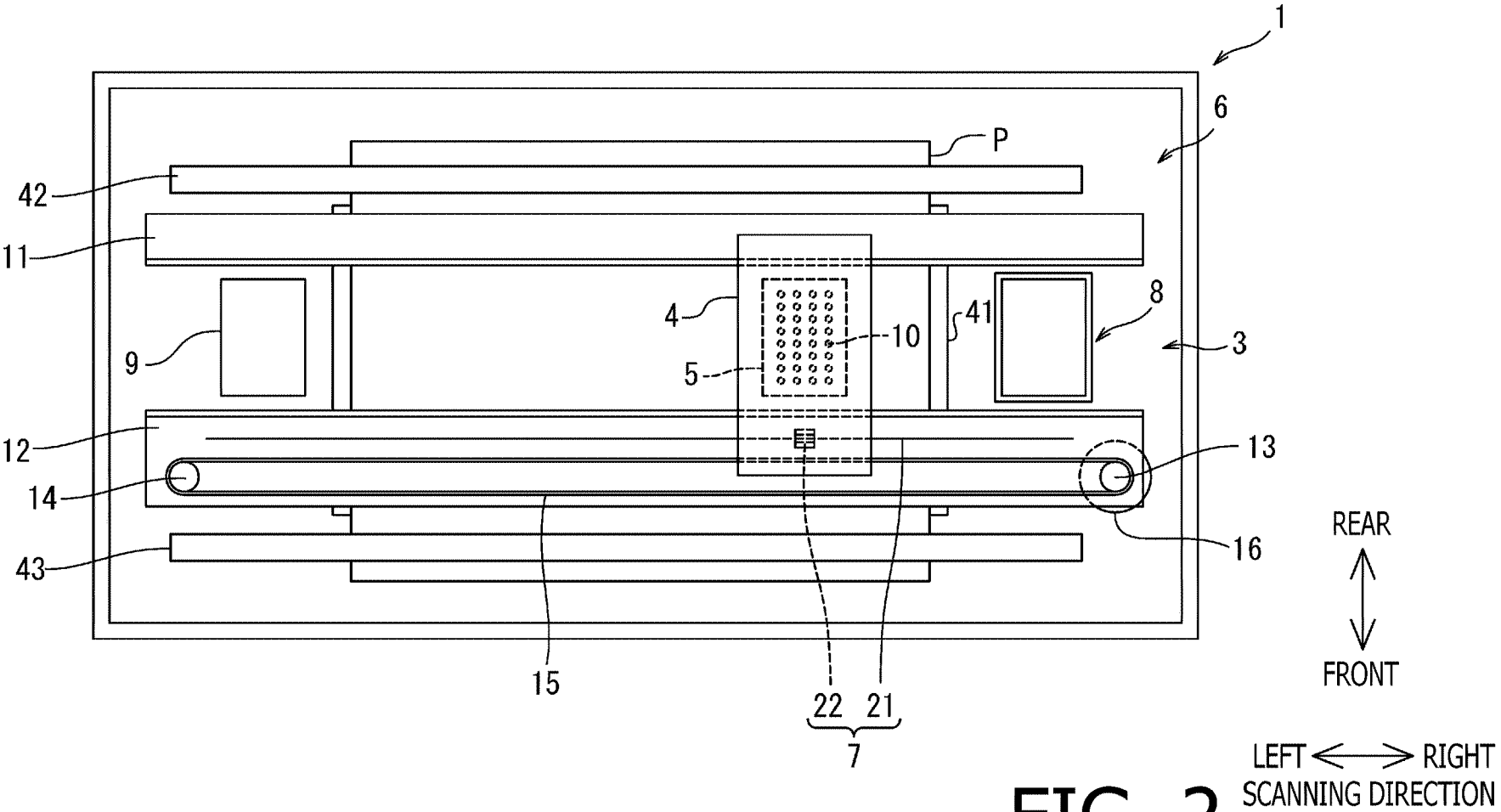
FIG. 2 is a plan view schematically showing the configuration of the inkjet printer in the illustrative embodiment according to one or more aspects of the present disclosure.

Hereinafter, an illustrative embodiment according to aspects of the present disclosure will be described with reference to the accompanying drawings. In the illustrative embodiment, an inkjet printer 1 is exemplified as a "printer" according to aspects of the present disclosure. In the following description, a front-to-rear direction, a left-to-right direction, and a vertical direction of the printer 1, which are mutually perpendicular to each other, will be defined as shown in FIGS. 1 and 2. As shown in FIG. 1, the printer 1 includes a feeder 2, an image recorder 3, and a controller 100.

The feeder 2 includes a feed tray 51 and a pickup roller 52 disposed above the feed tray 51. The feed tray 51 is configured to support one or more sheets P placed thereon. In response to a feed motor 53 (see FIG. 5) being driven, the pickup roller 52 picks up the one or more sheets P from the feed tray 51 on a sheet-by-sheet basis, under control by the controller 100. A sheet P picked up by the pickup roller 52 is conveyed along a guide 54 and fed to the image recorder 3.

As shown in FIG. 2, the image recorder 3 includes a carriage 4, an inkjet head (hereinafter referred to simply as a "head") 5, a conveyor 6, a linear encoder 7, a cap 8, and a flushing receiver 9. The carriage 4 is supported by two guiderails 11 and 12 extending in the left-to-right direction. The two guiderails 11 and 12 are spaced apart from each other in the front-to-rear direction. Pulleys 13 and 14 are disposed at two end portions of an upper surface of the guiderail 12 in the left-to-right direction, respectively. An endless rubber belt 15 is wound around the pulleys 13 and 14. The carriage 4 is attached to an intermediate portion of the belt 15 between the pulleys 13 and 14. A carriage motor 16 is connected with the right pulley 13. In response to the carriage motor 16 rotating forward and backward, the pulley 13 is driven to rotate, and thereby the belt 15 travels to reciprocate the carriage 4 along the left-to-right direction as the scanning direction. At this time, the left pulley 14 rotates in accordance with the traveling of the belt 15.

The head 5 is mounted on the carriage 4. Thus, the head 5 is configured to reciprocate along the scanning direction together with the carriage 4. A lower surface of the head 5 is a nozzle surface 10*a* (see FIG. 1) having a plurality of nozzles 10 formed therein. The nozzles 10 are configured to discharge ink droplets therefrom. The head 5 includes an ink flow channel and an actuator. The ink flow channel is configured to communicate with the plurality of nozzles 10. The actuator includes a plurality of driving elements configured to apply pressure on ink in the ink flow channel, thereby discharging the ink from the plurality of nozzles 10. A configuration of the actuator is not limited to a specific configuration. Nonetheless, for instance, a piezoelectric actuator may be employed as the actuator. In this case, the piezoelectric actuator may include, as the plurality of driving elements, a plurality of piezoelectric elements configured to apply pressure on the ink in the ink flow channel by utilizing deformation of piezoelectric layers due to inverse piezoelectric effect. In another instance, a plurality of heat generating elements for generating air bubbles in the ink by heat may be employed as the plurality of driving elements.

An amount of ink (i.e., a volume of an ink droplet) dischargeable from each nozzle 10 within each single discharge period to form an image on the sheet P by the head 5 may be one of four types of ink volumes such as a large-size ink droplet, a middle-size ink droplet, a small-size ink droplet, and non-discharge. Accordingly, four degrees of density may be expressed by each dot formed on the sheet P, depending on the amount of ink discharged from a corresponding nozzle 10. Thus, the printer 1 may form an image on the sheet P with four-level gradation. It is noted that the "discharge period" is a period of time required for the head 5 to move over a unit distance corresponding to a resolution in the scanning direction.

The conveyor 6 includes a platen 41 and two conveyance rollers 42 and 43. The platen 41 is disposed below the carriage 4 and positioned to face the carriage 4 from underneath. The platen 41 is longer than the sheet P in the left-to-right direction. The platen 41 is configured to support the sheet P when the printer 1 performs image formation on the sheet P.

The two conveyance rollers 42 and 43 are disposed to face each other across the platen 41 in the front-to-rear direction. The two conveyance rollers 42 and 43 are driven to rotate in synchronization with each other by a conveyance motor 37 (see FIG. 5) under control by the controller 100. Thereby, the two conveyance rollers 42 and 43 convey the sheet P fed by the feeder 2, to an area A (see FIG. 1) above the platen 41. The area A is set to be opposed to the carriage 4 in the vertical direction. Hereinafter, the area A may be referred to as the "opposed area A." A rotary encoder 40 (see FIG. 5) is attached to a rotational shaft of the conveyance roller 42. The rotary encoder 40 is configured to output a pulse signal according to the rotation of the conveyance roller 42. The controller 100 controls conveyance of the sheet P based on the pulse signal output from the rotary encoder 40.

As shown in FIG. 1, a sheet sensor 38 is disposed upstream of the conveyance rollers 42 and 43 in a conveyance direction. The sheet sensor 38 is configured to detect whether the sheet P exists in a detecting position on a conveyance path along which the sheet P is conveyed. The detecting position of the sheet sensor 38 is upstream of the conveyance rollers 42 and 43 in the conveyance direction. The controller 100 determines whether the sheet P exists in the opposed area A, based on a result of the detection by the sheet sensor 38 and information regarding control of the conveyance motor 37. Specifically, the controller 100 determines, as a first point of time when a leading end of the sheet P reaches the opposed area A, a point of time when a first conveyance distance over which the sheet P has been conveyed by the conveyance rollers 42 and 43 since the detection of the leading end of the sheet P by the sheet sensor 38 becomes equal to a distance between the detecting position of the sheet sensor 38 and the opposed area A in the conveyance direction. It is noted that the first conveyance distance is determined based on the pulse signal from the rotary encoder 40. Further, the controller 100 determines, as a second point of time when a trailing end of the sheet P goes out of the opposed area A, a point of time when a second conveyance distance over which the sheet P has been conveyed by the conveyance rollers 42 and 43 since the first point of time becomes equal to a sum of a length of the opposed area A (or the carriage 4) in the conveyance direction and a length of the sheet P in the conveyance direction. It is noted that the second conveyance distance is determined based on the pulse signal from the rotary encoder 40. The controller 100 determines that the sheet P exists in the opposed area A, during the period of time between the first point of time and the second point of time.

Further, a sheet sensor 39 is disposed downstream of the conveyance rollers 42 and 43 in the conveyance direction. The sheet sensor 39 is configured to detect whether the sheet P exists in a detecting position on the conveyance path. The detecting position of the sheet sensor 39 is downstream of the conveyance rollers 42 and 43 in the conveyance direction. The controller 100 determines whether a sheet jam has occurred, based on the pulse signal from the rotary encoder 40 and results of the detections by the sheet sensors 38 and 39. Specifically, the controller 100 determines that a sheet jam has occurred, when the sheet sensor 39 does not detect the sheet P even after a counted number of pulses of the pulse signal from the rotary encoder 40 since detection of the sheet P by the sheet sensor 38 has reached a value corresponding to a distance between the sheet sensors 38 and 39 in the conveyance direction.

Figure 3A:
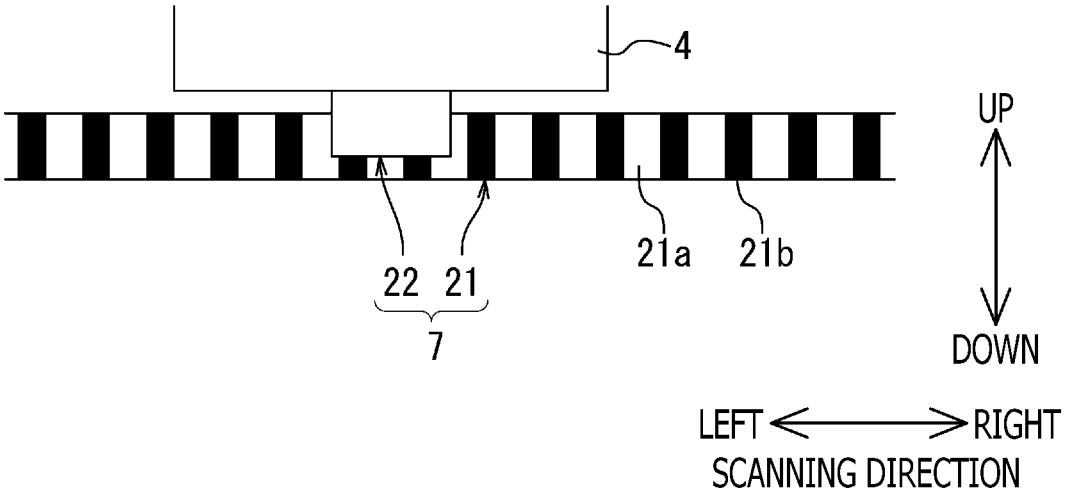
FIG. 3A shows a positional relationship between a scale and a sensor included in a linear encoder of the inkjet printer in the illustrative embodiment according to one or more aspects of the present disclosure.

The linear encoder 7 is a transmission type linear encoder. As shown in FIGS. 2 and 3, the linear encoder 7 includes a scale 21 and a sensor 22. The scale 21 is disposed on an upper surface of the guiderail 12. The scale 21 extends over a movable range of the carriage 4 in the scanning direction. As shown in FIG. 3A, the scale 21 includes a plurality of transmissive regions 21*a* and a plurality of non-transmissive regions 21*b* that are alternately arranged along the scanning direction. All the transmissive regions 21*a* have a uniform width in the scanning direction. The transmissive regions 21*a* are formed at regular intervals along the scanning direction on the scale 21. All the non-transmissive regions 21*b* have a uniform width in the scanning direction. The non-transmissive regions 21*b* are formed at regular intervals along the scanning direction on the scale 21. Each transmissive region 21*a* is a region that allows light to pass therethrough. Each non-transmissive region 21*b* is a region that does not allow light to pass therethrough.

The sensor 22 is mounted on the carriage 4. The sensor 22 includes a light emitting element 26 and a light receiving element 27. The light emitting element 26 and the light receiving element 27 are disposed to face each other across the scale 21 in the front-to-rear direction. The light emitting element 26 is configured to emit light toward the light receiving element 27. The light receiving element 27 is configured to receive the light emitted by the light emitting element 26. The sensor 22 is configured to detect the transmissive regions 21*a* and the non-transmissive regions 21*b* in a detecting position on the scale 21. The detecting position of the sensor 22 is between the light emitting element 26 and the light receiving element 27 in the front-to-rear direction.

Figure 3B:
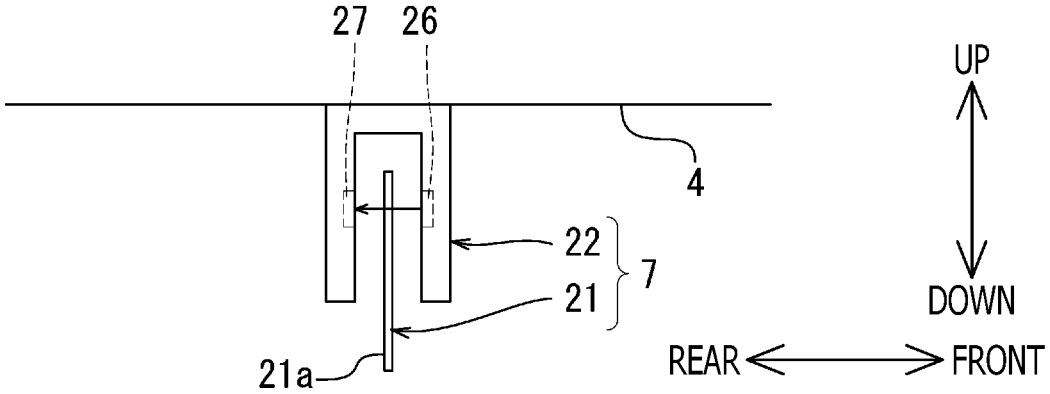
FIG. 3B shows the sensor facing a transmissive region of the scale in a front-to-rear direction, in the illustrative embodiment according to one or more aspects of the present disclosure.
Figure 3C:
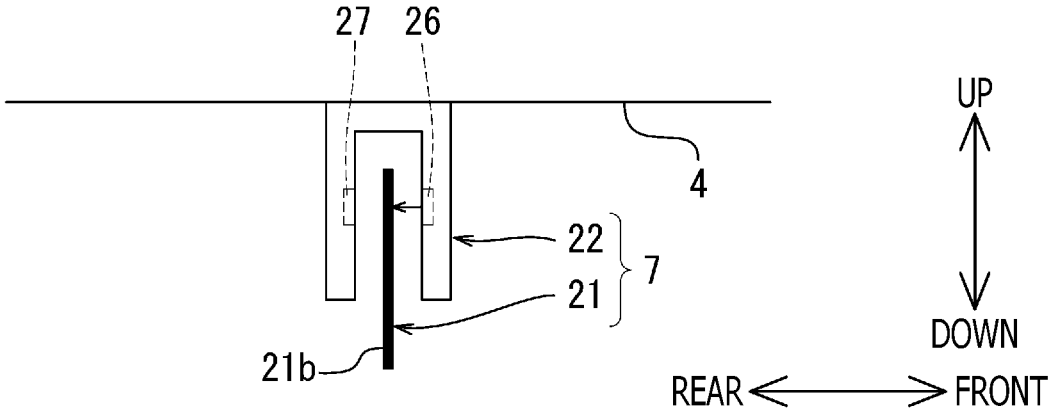
FIG. 3C shows the sensor facing a non-transmissive region of the scale in the front-to-rear direction, in the illustrative embodiment according to one or more aspects of the present disclosure.

Specifically, as shown in FIG. 3B, when a transmissive region 21*a* is in the detecting position of the sensor 22, the light emitted by the light emitting element 26 is transmitted through the transmissive region 21*a* and received by the light receiving element 7. Meanwhile, as shown in FIG. 3C, when a transmissive region 21*b* is in the detecting position of the sensor 22, the light emitted by the light emitting element 26 is blocked by the non-transmissive region 21*b*, without reaching the light receiving element 7. Therefore, as the detecting position of the sensor 22 moves in response to movement of the carriage 4 along the scanning direction, the light receiving element 27 is alternately and repeatedly brought into a light-receivable state and a non-light-receivable state.

As shown in FIG. 4A, when the light receiving element 27 is not receiving the light from the light emitting element 26, the pulse signal output from the sensor 22 has an electric potential V1. Meanwhile, when the light receiving element 27 is receiving the light from the light emitting element 26, the pulse signal output from the sensor 22 has an electric potential V2 less than V1. Namely, when the pulse signal output from the sensor 22 has the electric potential V1, it represents that the sensor 22 is detecting a non-transmissive region 21*b*. Further, when the pulse signal output from the sensor 22 has the electric potential V2, it represents that the sensor 22 is detecting a transmissive region 21*a*. As will be described in detail later, in the illustrative embodiment, the controller 100 obtains a carriage velocity Vcr as a velocity of the carriage 4 based on results of detecting the transmissive regions 21*a* and the non-transmissive regions 21*b* by the sensor 22.

As shown in FIG. 2, the cap 8 is disposed on the right of the platen 41. Accordingly, in the printer 1, the carriage 4 is configured to move to a standby position where the nozzle surface 10*a* is opposed to the cap 8 in the vertical direction. The cap 8 is movable along the vertical direction by a lifting mechanism (not shown). After the carriage 4 is placed in the standby position, the cap 8 is moved up toward the head 5 and brought into close contact with the nozzle surface 10*a*, so as to cover the plurality of nozzles 10. It is noted that the cap 8 may not necessarily be in close contact with the nozzle surface 10*a*. For instance, the head 5 may have a frame surrounding the nozzle surface 10*a*. In this case, the cap 8 may be in close contact with the frame to cover the plurality of nozzles 10. When the printer 1 is not performing printing, the carriage 4 is in the standby position, and the plurality of nozzles 10 are covered with the cap 8. Thereby, it is possible to prevent drying of ink inside the nozzles 10.

The flushing receiver 9 is disposed on the left of the platen 41. Accordingly, in the printer 1, the carriage 4 is configured to move to a flushing position where the nozzle surface 10*a* is opposed to the flushing receiver 9 in the vertical direction. After placing the carriage 4 in the flushing position, the printer 1 performs flushing to discharge thickened ink from each nozzle 10.

As shown in FIG. 5, the controller 100 includes a CPU ("CPU" is an abbreviation of "Central Processing Unit") 101, a ROM ("ROM" is an abbreviation of "Read Only Memory") 102, a RAM ("RAM" is an abbreviation of "Random Access Memory") 103, a non-volatile memory 104, an oscillation circuit 105, and an ASIC ("ASIC" is an abbreviation of "Application Specific Integrated Circuit") 106. The ROM 102 stores various kinds of fixed data and programs 102*a* executable by the CPU 101. The RAM 103 is configured to temporarily store data (e.g., image data) necessary for execution of the programs 102*a*. The non-volatile memory 104 stores below-mentioned abnormal area information. The oscillation circuit 105 is configured to output a clock signal of a particular frequency. The ASIC 106 is connected with various elements included in the printer 1 such as the head 5, the sensor 22, the carriage motor 16, the conveyance motor 37, the sheet sensors 38 and 39, a touch panel 99, and a communication I/F ("I/F" is an abbreviation of "interface") 110.

For instance, the controller 100 may be configured to perform various processes by only a single CPU 101 or cooperatively by two or more CPUs 101. In another instance, the controller 100 may be configured to perform the various processes by only a single ASIC 106 or cooperatively by two or more ASICs 106. In a further instance, the controller 100 may be configured such that one or more CPUs 101 and one or more ASICs 106 perform the various processes in corporation with each other.

In the illustrative embodiment, the controller 100 performs the various processes by the CPU 101 and the ASIC 106 in accordance with the programs 102*a* stored in the ROM 102. For instance, when receiving a print instruction from an external device 200 (e.g., a PC) via the communication I/F 110, the controller 100 controls relevant elements such as the head 5, the carriage motor 16, and the conveyance motor 37 to perform a printing process to print, on a sheet P, an image based on the image data stored in the RAM 103.

Specifically, when receiving the print instruction, the controller 100 first generates ink discharge data by performing image processing (e.g., known error diffusion processing as a quantization process) for the image data stored in the RAM 103. The ink discharge data is four-level gradation data corresponding to the four types of ink volumes dischargeable from each nozzle 10 within each single discharge period. Further, the controller 100 controls the pickup roller 52 and the conveyance motor 37 to convey the sheet P from the feed tray 51 toward the opposed area A. Afterward, the controller 100 determines whether the sheet P exists in the opposed area A, based on the result of the detection by the sheet sensor 38. Then, when determining that the sheet P exists in the opposed area A, the controller 100 starts a printing process based on the generated ink discharge data. In the printing process, the controller 100 alternately and repeatedly performs a recording process and a conveyance process. In each recording process, the controller 100 causes the nozzles 10 to discharge ink based on the ink discharge data during a single pass (i.e., a single movement of the carriage 4 in a specific direction along the scanning direction). In each conveyance process, the controller 100 causes the conveyance mechanism 6 to convey the sheet P forward over a particular distance.

In each recording process to perform printing for a single pass, the controller 100 controls the carriage 4 to move with a target velocity as a constant velocity. Specifically, the controller 100 drives the carriage motor 16 with feedback control based on a deviation of a current carriage velocity Vcr from the target velocity. The current carriage velocity Vcr is obtained based on the result of the detection by the sensor 22. In the illustrative embodiment, the controller 100 drives the carriage motor 16 with PID control so as to cancel the deviation of the obtained current carriage velocity Vcr from the target velocity.

Accordingly, when the carriage velocity Vcr is lower than the target velocity, the controller 100 responds by controlling the carriage motor 16 to accelerate the carriage 4. At this time, a value of an electric current applied to the carriage motor 16 is larger than a normal current value for the carriage motor 16 when the carriage velocity Vcr is equal to the target velocity. In this response, the carriage Vcr converges to the target velocity. Nonetheless, in the process of the carriage Vcr converging to the target velocity, the carriage velocity Vcr overshoots the target velocity.

Meanwhile, when the carriage velocity Vcr is higher than the target velocity, the controller 100 responds by controlling the carriage motor 16 to decelerate the carriage 4. At this time, the value of the electric current applied to the carriage motor 16 is smaller than the normal current value. The value of the electric current applied to the carriage motor 16 is detected by a current sensor 55 (see FIG. 5), and a detection signal corresponding to the detected current value is output from the current sensor 55 to the controller 100.

The printer 1 has a plurality of different velocities settable as the target velocity of the carriage 4. The controller 100 sets, as the target velocity, one of the plurality of settable velocities in accordance with the print instruction (more specifically, in accordance with an instruction, included in the print instruction, regarding a resolution of the image to be printed on the sheet P). Further, in the recording process, the controller 100 controls the carriage motor 16 such that the carriage 4 moves with the set target velocity as a constant velocity.

In the meantime, the sheet P might be deformed to cockle or curl after absorbing ink. When the sheet P is deformed, as shown in FIG. 6A, the nozzle surface 10*a* of the head 5 might rub against the deformed sheet P while the recording process is in execution. Hereinafter, such rubbing between the head 5 and the sheet P may be referred to as "head-sheet rubbing." When the carriage 4 is continuously moved even in a state where "head-sheet rubbing" is occurring, it might cause a sheet jam or an ink discharge defect due to the damaged nozzle surface 10*a*.

Hence, when moving the carriage 4, the controller 100 obtains the carriage velocity Vcr as the current velocity of the carriage 4, and determines whether "head-sheet rubbing" is occurring, based on the obtained carriage velocity Vcr. Then, when determining that "head-sheet rubbing" is occurring, the controller 100 stops the carriage 4 and interrupts the recording process in execution. This will be described in detail below.

As described above, in the recording process, the controller 100 controls the carriage motor 16 to move the carriage 4 at the target velocity. Under this control, the carriage 4 moves substantially at the target velocity, though it is somewhat affected by fluctuation of a rotational velocity of the carriage motor 16. However, when "head-sheet rubbing" occurs, the carriage velocity Vcr is made much lower than the target velocity due to a frictional force between the nozzles surface 10*a* and the sheet P. Accordingly, the controller 100 may determine that "head-sheet rubbing" is occurring, when the carriage velocity Vcr obtained while the controller 100 is controlling the carriage motor 16 is less than a particular threshold (hereinafter referred to as a "lower limit threshold"). It is noted that the lower limit threshold corresponds to a velocity lower than the target velocity. Further, a difference between the target velocity and the lower limit threshold is larger than a possible reduction in the carriage velocity Vcr caused by the fluctuation of the rotational velocity of the carriage motor 16. For instance, when the carriage velocity Vcr varies by about 5% of the target velocity due to the fluctuation of the rotational velocity of the carriage motor 16, the lower limit threshold may be set to be 90% of the target velocity.

The carriage velocity Vcr is calculated by using the following expression 1.

$$Vcr=W/(CK/F) \quad \text{(Expression 1)},$$

where W represents a width of each non-transmissive region in the scanning direction, F represents the frequency of the clock signal output from the oscillation circuit 105, and CK represents a clock number of the clock signal output from the oscillation circuit 105.

In the expression 1, the width W and the frequency F are predetermined fixed values. Therefore, the carriage velocity Vcr is calculated by obtaining the clock number CK. The clock number CK is obtained by counting the number of clocks of the clock signal output from the oscillation circuit 105 during a particular period of time from a point of time when the electric potential of the pulse signal from the sensor 22 rises from V2 to V1 until a point of time when the electric potential of the pulse signal from the sensor 22 falls from V1 to V2 (i.e., during a particular period of time for which the electric potential of the pulse signal from the sensor 22 is maintained to be V1). Hereinafter, the particular period of time may be referred to as a "V1 maintenance period." Thus, it is possible to determine whether "head-sheet rubbing" is occurring, by obtaining the carriage velocity Vcr based on the result of the detection by the sensor 22 while the carriage 4 is moving. It is noted that the carriage velocity Vcr is obtained each time the electric potential of the pulse signal output from the sensor 22 falls from V1 to V2.

In the meantime, the scale 21 might have an abnormality such as being partially stained with ink. For instance, when a sheet jam has occurred, the user performs a sheet removing operation to remove a sheet stuck in the printer 1. The scale 21 might be stained with such ink as attached onto the scale 21 in the sheet removing operation. Thus, when the scale 21 has an abnormality such as being stained, the pulse signal output from the sensor 22 differs from a proper pulse signal from the sensor 22. Thereby, the carriage velocity Vcr obtained by using the sensor 22 might be lower than an actual velocity of the carriage 4. This will be described more specifically below.

First, suppose for instance that a non-transmissive region 21*b* is stained. The non-transmissive region 21*b* is originally configured to prevent light from passing therethrough. Therefore, even when the non-transmissive region 21*b* is stained, the pulse signal output from the sensor 22 does not differ from the proper pulse signal therefrom.

Meanwhile, when a transmissive region 21*a* is stained, the light emitted by the light emitting element 26 is blocked by the stained transmissive region 21*a*, without reaching the light receiving element 27. Consequently, the pulse signal output from the sensor 22 differs from the proper pulse signal therefrom due to the stained transmissive region 21*a*.

For instance, as shown in FIG. 4B, when both a transmissive region 21*a* and an adjoining non-transmissive region 21*b* are stained, the electric potential of the pulse signal from the sensor 22 is maintained to be V1 while the detecting position of the sensor 22 is going through the non-transmissive region 21*b* and a stained part of the transmissive region 21*a*.

Further, as shown in FIG. 4C, when a transmissive region 21*a* is entirely stained, the electric potential of the pulse signal from the sensor 22 is maintained to be V1 while the detecting position of the sensor 22 is going through the entirely-stained transmissive region 21*a* and the two adjoining non-transmissive regions 21*b*.

As described above, when a transmissive region 21*a* of the scale 21 is stained, the V1 maintenance period is longer than a period of time during which the detecting position of the sensor 22 is within a non-transmissive region 21*b*. Consequently, the clock number CK obtained during the V1 maintenance period is more than the number of clocks counted while the detecting position of the sensor 22 is within a non-transmissive region 21*b*. Namely, a value assigned to the clock number CK in the above expression 1 is more than a proper value of the clock number CK. Meanwhile, in the expression 1, the width W of the non-transmissive region 21*b* in the scanning direction is a fixed value. Hence, as the value assigned to the clock number CK in the expression 1 is more than the proper value of the clock number CK, the carriage velocity Vcr calculated by using the expression 1 is lower than the actual velocity of the carriage 4. Consequently, even though "head-sheet rubbing" is not occurring, when the carriage velocity Vcr is less than the lower limit threshold, the controller 100 makes an erroneous determination that "head-sheet rubbing" is occurring. In this case, since the recording process is unnecessarily interrupted, the printer 1 is not user-friendly in this regard.

In the illustrative embodiment, an abnormal area on the scale 21 is set as an area having an abnormality due to which the carriage velocity Vcr is equal to or less than a particular threshold lower than the target velocity. When the carriage velocity Vcr is less than the lower limit threshold while the detecting position of the sensor 22 is out of the abnormal area on the scale 21, the controller 100 is allowed to determine that "head-sheet rubbing" is occurring. Meanwhile, when the carriage velocity Vcr is less than the lower limit threshold while the detecting position of the sensor 22 is within the abnormal area on the scale 21, the controller 100 is not allowed to determine whether "head-sheet rubbing" is occurring.

When the carriage 4 is continuously moved even after "head-sheet rubbing" has occurred while the carriage 4 is moving, the head 5 and the sheet P are not held in contact with each other but are alternately and repeatedly brought into contact and non-contact with each other. Accordingly, as shown in FIGS. 6B and 8B, when the head 5 and the sheet P are temporarily brought into non-contact with each other after "head-sheet rubbing" has occurred, the controller 100 performs the aforementioned feedback control to drive the carriage motor 16 such that the carriage velocity Vcr is equal to the target velocity. In this feedback control, the carriage velocity Vcr overshoots the target velocity.

Likewise, when the carriage velocity Vcr is less than the lower limit threshold due to the abnormality on the scale 21, as shown in FIG. 7B, the controller 100 performs the feedback control to drive the carriage motor 16 such that the carriage velocity Vcr is equal to the target velocity. In this feedback control, the carriage velocity Vcr overshoots the target velocity.

The inventors have found a fact that an overshooting amount by which the carriage velocity Vcr overshoots the target velocity under the feedback control after the carriage velocity Vcr is lower than the target velocity due to "head-sheet rubbing" is larger than an overshooting amount by which the carriage velocity Vcr overshoots the target velocity under the feedback control after the carriage velocity Vcr is lower than the target velocity due to the abnormality on the scale 21. Further, the inventors consider that the found fact results from differences in behavior of the carriage velocity Vcr varying under the feedback control between when the carriage velocity Vcr is lower than the target velocity due to "head-sheet rubbing" and when the carriage velocity Vcr is lower than the target velocity due to the abnormality on the scale 21. For instance, the above differences may include a difference in period of time for which the carriage velocity Vcr is lower than the target velocity. Further, the differences may include a difference in value of the carriage velocity Vcr during the period of time for which the carriage velocity Vcr is lower than the target velocity.

Accordingly, as shown in FIGS. 7B and 8B, when the carriage velocity Vcr is less than the lower limit threshold while the detecting position of the sensor 22 is within the abnormal area, an overshooting amount of the carriage velocity Vcr under the feedback control in a state where "head-sheet rubbing" is occurring is larger than an overshooting amount of the carriage velocity Vcr under the feedback control in a state where "head-sheet rubbing" is not occurring. Namely, it is possible to determine whether "head-sheet rubbing" is occurring, based on the overshooting amount of the carriage velocity Vcr. As shown in FIG. 8B, the carriage velocity Vcr may overshoot the target velocity while the detecting position of the sensor 22 is going through the abnormal area and an adjoining area. The adjoining area is adjacent to a downstream end of the abnormal area in a moving direction in which the carriage 4 moves in the recording process. Further, the adjoining area has a particular width in the moving direction of the carriage 4.

In view of the above, in the illustrative embodiment, an overshoot threshold is set as a particular threshold higher than the target velocity. When the carriage velocity Vcr is less than the lower limit threshold while the detecting position of the sensor 22 is within the abnormal area, the controller 100 does not interrupt the recording process at that point of time. Further, the controller 100 sets, as a particular area, an area including the abnormal area and the aforementioned adjoining area. Specifically, for instance, when the moving direction of the carriage 4 in the recording process currently in execution is a rightward direction, the particular area is set as an area including the abnormal area and the adjoining area that is adjacent to a right end of the abnormal area on the scale 21. Then, when the carriage velocity Vcr exceeds the overshoot threshold while the detecting position of the sensor 22 is within the particular area, the controller 100 determines that "head-sheet rubbing" is occurring, and interrupts the recording process in execution.

The adjoining area on the scale 21 is not the abnormal area. Hence, when the carriage velocity Vcr is less than the lower limit threshold while the detecting position of the sensor 22 is within the adjoining area, it may be determined that "head-sheet rubbing" is occurring. Accordingly, when the carriage velocity Vcr is out of a normal range between the overshoot threshold and the lower limit threshold while the detecting position of the sensor 22 is within the adjoining area, the controller 100 determines that "head-sheet rubbing" is occurring, and interrupts the recording process in execution.

Thus, in order to accurately determine whether "head-sheet rubbing" is occurring, it is required to appropriately set the abnormal area on the scale 21 and the overshoot threshold. In the illustrative embodiment, after receiving a print instruction from the external device 200, the controller 100 performs a below-mentioned measurement process. Then, based on results of the detection by the sensor 22 in the measurement process, the controller 100 generates abnormal area information regarding the abnormal area on the scale 21, and sets the overshoot threshold. This will be described more specifically below.

The controller 100 performs the measurement process when determining the sheet P is not positioned in the opposed area A. In the measurement process, the controller 100 sets, as a target velocity, the same velocity as the target velocity of the carriage 4 in the printing process. Further, the controller 100 performs feedback control such that the carriage 4 moves with the set target velocity as a constant velocity along the scanning direction within a movable range from the standby position through the flushing position. Then, based on the results of the detection by the sensor 22 during the movement of the carriage 4 along the scanning direction, the controller 100 generates abnormal area information regarding the abnormal area on the scale 21. This will be described more specifically below.

The sheet P is not positioned in the opposed area A during the measurement process. Therefore, the carriage 4 performs a uniform motion at substantially the same velocity as the set target velocity, without the carriage velocity Vcr being lowered due to "head-sheet rubbing." Accordingly, as shown in FIG. 4A, when the scale 21 is not stained, every V1 maintenance period has a uniform length of time and is the same as a period of time during which the sensor 22 is detecting a non-transmissive region 21*b*. Hence, the carriage velocity Vcr calculated by substituting into the above expression 1 the clock number CK obtained during each V1 maintenance period is substantially equal to the set target velocity.

Meanwhile, as shown in FIGS. 4B and 4C, when a transmissive region 21*a* on the scale 21 is at least partially stained, and a stained part of the transmissive region 21*a* extends up to one or two adjoining non-transmissive regions 21*b*, the stained part of the transmissive region 21*a* and the one or two adjoining non-transmissive regions 21*b* on the scale 21 are regarded as an abnormal area. When the detecting position of the sensor 22 is within the abnormal area, the V1 maintenance period is longer than when the detecting position of the sensor 22 is out of the abnormal area, and the clock number CK obtained during the V1 maintenance period is more than when the detecting position of the sensor 22 is out of the abnormal area. Therefore, the carriage velocity Vcr calculated by substituting the obtained clock number CK into the expression 1 is lower than the set target velocity. Thus, the controller 100 sets, as the abnormal area, such an area that the carriage velocity Vcr, which is calculated by substituting into the expression 1 the clock number CK obtained during the V1 maintenance period when the detecting position of the sensor 22 is within the area, is lower than a particular threshold. This particular threshold is a velocity lower than the target velocity by a potential error due to disturbance (e.g., the fluctuation of the rotational velocity of the carriage motor 16).

The current detecting position of the sensor 22 is obtained by counting the number of non-transmissive regions 21*b* detected by the sensor 22 during movement of the carriage 4 from the standby position. The non-volatile memory 104 stores the counted number (see FIG. 5) of the non-transmissive regions 21*b* detected by the sensor 22 during the movement of the carriage 4 from the standby position. The controller 100 increments the counted number stored in the non-volatile memory 104 by one, each time the sensor 22 detects a non-transmissive region 21*b* (i.e., each time the electric potential of the pulse signal from the sensor 22 rises from V2 to V1) while the carriage 4 is moving leftward along the scanning direction. Meanwhile, the controller 100 decrements the counted number stored in the non-volatile memory 104 by one, each time the sensor 22 detects a non-transmissive region 21*b* while the carriage 4 is moving rightward along the scanning direction. Thereby, it is possible to obtain the current detecting position of the sensor 22 and grasp a position of the abnormal area on the scale 21. Thus, the controller 100 generates the abnormal area information regarding the abnormal area and the position thereof on the scale 21, and stores the generated abnormal area information into the non-volatile memory 104 (see FIG. 5).

It is noted that when the carriage 4 is accelerated or decelerated, the carriage velocity Vcr largely fluctuates due to large fluctuation of the rotational velocity of the carriage motor 16. Therefore, the abnormal area information as generated based on results of the detection by the sensor 22 when the carriage 4 is accelerated or decelerated might be inaccurate. Meanwhile, when the carriage 4 is controlled to move at a constant velocity, the carriage velocity Vcr does not fluctuate so largely. In the illustrative embodiment, the controller 100 controls the carriage 4 to move at a constant velocity, and generates the abnormal area information based on the results of the detection by the sensor 22 when the carriage 4 is controlled to move at the constant velocity. Thereby, it is possible to improve the accuracy of the abnormal area information.

Further, the controller 100 sets the overshoot threshold based on a maximum one of the carriage velocities Vcr obtained during the measurement process. As described above, "head-sheet rubbing" does not occur while the measurement process is in execution. Hence, the maximum one of the carriage velocities Vcr obtained during the measurement process is a maximum velocity of the carriage 4 when "head-sheet rubbing" is not occurring. In the illustrative embodiment, for instance, in view of influences of noises, the overshoot threshold may be set to a value several percent higher than the maximum one of the obtained carriage velocities Vcr. Thus, in the illustrative embodiment, when the carriage velocity Vcr exceeds the overshoot threshold in the recording process, it is possible to make an accurate determination that this has been caused by "head-sheet rubbing." Accordingly, it is possible to prevent the recording process from being unnecessarily interrupted even though "head-sheet rubbing" is not occurring. In another instance, as a modification according to aspects of the present disclosure, the overshoot threshold may be set to the maximum one of the carriage velocities Vcr obtained during the measurement process.

It is noted that the overshoot threshold is such a value that the carriage velocity Vcr never exceeds the value even when the carriage velocity Vcr overshoots after becoming lower than the target velocity but not less than the lower limit threshold. In other words, the overshoot threshold is such a value that the carriage velocity Vcr may exceed the value only when the carriage velocity Vcr overshoots after becoming less than the lower limit threshold.

In the following description, a sequence of operations by the printer 1 will be described with reference to FIG. 9. At a time when a process shown in FIG. 9 is started, the carriage 4 is in the standby position, and there is no sheet P on the conveyance path including the opposed area A.

As shown in FIG. 9, the controller 100 determines whether the controller 100 has received a print instruction from the external device 200 (S1). When determining that the controller 100 has not received a print instruction from the external device 200 (S1: No), the controller 100 repeatedly performs S1 until the controller 100 receives a print instruction. Meanwhile, when determining that the controller 100 has received a print instruction from the external device 200 (S1: Yes), the controller 100 performs the measurement process (S2). Specifically, the controller 100 sets the target velocity to the same value as the target velocity of the carriage 4 in the printing process. Further, the controller 100 performs feedback control of the carriage motor 16 in such a manner that the carriage 4 moves with the set target velocity as a constant velocity from the standby position to the flushing position. At this time, the controller 100 controls the head 5 not to discharge ink from the nozzles 10.

Subsequently, the controller 100 generates the abnormal area information based on the results of the detection by the sensor 22 during the measurement process in S2, and stores the generated abnormal area information into the non-volatile memory 104 (S3). Then, the controller 100 sets the overshoot threshold based on the maximum one of the carriage velocities Vcr obtained during the measurement process in S2 (S4).

Next, the controller 100 performs a flushing process to flush the head 5, and performs an ink discharge data generating process to generate the ink discharge data from the image data stored in the RAM 103 (S5). Then, the controller 100 controls the pickup roller 52 and the conveyance motor 37 to convey a sheet P placed on the feed tray 51 to the opposed area A (S6). Since the sheet P is conveyed to the opposed area A in S6, the controller 100 determines that the sheet P is positioned in the opposed area A.

Subsequently, the controller 100 starts a recording process to perform printing for a single pass (S7). Specifically, the controller 100 controls the carriage motor 16 to start moving the carriage 4 along the scanning direction, and controls the head 5 to start discharging ink from the nozzles 10. While controlling the carriage motor 16, the controller 100 sequentially obtains the detecting position of the sensor 22 and the carriage velocity Vcr based on the results of the detection by the sensor 22.

Next, the controller 100 determines whether the carriage velocity Vcr is less than the lower limit threshold (S8). When determining that the carriage velocity Vcr is not less than the lower limit threshold (S8: No), the controller 100 determines that "head-sheet rubbing" is not occurring, and goes to S18. Meanwhile, when determining that the carriage velocity Vcr is less than the lower limit threshold (S8: Yes), the controller 100 refers to the abnormal area information stored in the non-volatile memory 104, and determines whether the detecting position of the sensor 22 is within the abnormal area at a point of time when the carriage velocity Vcr has become less than the lower limit threshold (S9). When determining that the detecting position of the sensor 22 is out of the abnormal area at the point of time when the carriage velocity Vcr has become less than the lower limit threshold (S9: No), the controller 100 determines that "head-sheet rubbing" is occurring, and goes to S15. Meanwhile, when determining that the detecting position of the sensor 22 is within the abnormal area at the point of time when the carriage velocity Vcr has become less than the lower limit threshold (S9: Yes), the controller 100 does not interrupt but continues the recording process at this point of time. Further, at this time, the controller 100 sets, as the particular area, an area including the abnormal area and the adjoining area that is adjacent to the downstream end of the abnormal area in the moving direction of the carriage 4 (S10).

Afterward, the controller 100 determines whether the detecting position of the sensor 22 is within the abnormal area of the set particular area (S11). When determining that the detecting position of the sensor 22 is within the abnormal area of the set particular area (S11: Yes), the controller 100 determines whether the current carriage velocity Vcr is higher than the overshoot threshold (S12). When determining that the current carriage velocity Vcr is not higher than the overshoot threshold (S12: No), the controller 100 goes back to S11. Meanwhile, when determining that the current carriage velocity Vcr is higher than the overshoot threshold (S12: Yes), the controller 100 determines that "head-sheet rubbing" is occurring, and goes to S15.

In S11, when determining that the detecting position of the sensor 22 is out of the abnormal area of the set particular area (S11: No), the controller 100 determines whether the detecting position of the sensor 22 is within the adjoining area of the set particular area (S13). When determining that the detecting position of the sensor 22 is out of the adjoining area of the set particular area (S13: No), the controller 100 determines that "head-sheet rubbing" is not occurring, and goes to S18. Meanwhile, when determining that the detecting position of the sensor 22 is within the adjoining area of the set particular area (S13: Yes), the controller 100 determines whether the current carriage velocity Vcr is within the normal range between the overshoot threshold and the lower limit threshold (S14). When determining that the current carriage velocity Vcr is within the normal range (S14: Yes), the controller 100 goes back to S13. Meanwhile, when determining that the current carriage velocity Vcr is out of the normal range (S14: No), the controller 100 determines that "head-sheet rubbing" is occurring, and goes to S15.

In S15, the controller 100 controls the carriage motor 16 to stop the carriage 4, thereby interrupting the recording process in execution. Then, after standing by for a particular period of time, the controller 100 controls the conveyance motor 37 to discharge the sheet P out of the opposed area A (S16). When the sheet P is deformed by absorbing ink, the deformed sheet P is gradually flattened and consequently separated from the head 5 by being left as it is for a while. Thus, as described above, by standing by for the particular period of time before discharging the sheet P out of the opposed area A, the controller 100 may prevent occurrence of "head-sheet rubbing" when discharging the sheet P.

Subsequently, the controller 100 regenerates ink discharge data from the same image data so as to make an amount of ink to be discharged onto each single sheet P smaller than in the previous printing process using the earlier-generated ink discharge data (S17). Specifically, for instance, the controller 100 may regenerate the ink discharge data by changing a threshold for the quantization process so as to reduce respective rates of the large-size ink droplets and the middle-size ink droplets to be discharged onto each single sheet P and increase a rate of the small-size ink droplets to be discharged onto each single sheet P. Afterward, the controller 100 goes back to S6 to perform reprinting on a new sheet P based on the regenerated ink discharge data. Thus, by regenerating the ink discharge data such that a smaller amount of ink is discharged onto each single sheet P, it is possible to suppress deformation of the new sheet P due to ink discharged from the nozzles 10 in the reprinting. Consequently, it is possible to prevent occurrence of "head-sheet rubbing" during the reprinting.

In S18, the controller 100 determines that "head-sheet rubbing" is not occurring, and continues to perform the recording process currently in execution. Then, the controller 100 determines whether the current recording process (i.e., printing for the current single pass) is completed (S19). When determining that the current recording process is not completed (S19: No), the controller 100 goes back to S8 to continue to perform the recording process currently in execution. Meanwhile, when determining that the current recording process is completed (S19: Yes), the controller 100 determines whether printing on the single sheet P is completed (S20). When determining that the printing on the single sheet P is not completed (S20: No), the controller 100 controls the conveyance motor 37 to convey the sheet P forward over a particular distance (S21). Thereafter, the controller 100 goes to S7 to perform another recording process to perform printing for a next single pass. Meanwhile, when determining that the printing on the single sheet P is completed (S20: Yes), the controller 100 controls the conveyance motor 37 to convey the printed sheet P forward and discharge the printed sheet P out of the opposed area A (S22). Thereafter, the controller 100 determines whether all printing based on the received print instruction is completed (S23). When determining that all the printing based on the received print instruction is completed (S23: Yes), the controller 100 controls the carriage motor 16 to move the carriage 4 to the standby position. Afterward, the controller 100 goes back to S1. Meanwhile, when determining that all the printing based on the received print instruction is not completed (S23: No), the controller 100 goes back to S6 to perform printing on another sheet P.

As described above, in the illustrative embodiment, when the carriage velocity Vcr exceeds the overshoot threshold during execution of the recording process, the controller 100 determines that "head-sheet rubbing" is occurring, and interrupts the recording process in execution. Thereby, it is possible to prevent the head from being damaged by "head-sheet rubbing" and avoid unnecessary interruption of the recording process.

Further, when the obtained carriage velocity Vcr is less than the lower limit threshold while the detecting position of the sensor 22 is out of the abnormal area on the scale 21, the controller 100 determines that this is caused by not the abnormality on the scale 21 but "head-sheet rubbing," and interrupts the recording process in execution. Thereby, it is possible to interrupt the recording process earlier than when the recording process is interrupted in response to the carriage velocity Vcr exceeding the overshoot threshold after being less than the lower limit threshold. Consequently, it is possible to more certainly prevent the head 5 from being damaged due to "head-sheet rubbing."

Further, the controller 100 performs the measurement process while moving the carriage 4 from the standby position to the flushing position in preparation for the flushing process to be performed prior to the printing process. Thus, there is no need to separately move the carriage 4 only for the measurement process.

Hereinabove, the illustrative embodiment according to aspects of the present disclosure has been described. Aspects of the present disclosure may be practiced by employing conventional materials, methodology and equipment. Accordingly, such materials, equipment and methodology are not set forth herein in detail. In the previous descriptions, numerous specific details are set forth, such as specific materials, structures, processes, etc., in order to provide a thorough understanding of the present disclosure. However, it should be recognized that aspects of the present disclosure may be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that aspects of the present disclosure are capable of use in various other combinations and environments and are capable of changes or modifications within the scope of the inventive concept as expressed herein. For instance, the following modifications according to aspects of the present disclosure are feasible.

A first modification according to aspects of the present disclosure will be described with reference to FIGS. 10A and 10B. In the aforementioned illustrative embodiment, the controller 100 performs the measurement process during a print preparation period from when the controller 100 receives a print instruction until when the controller 100 starts a printing process based on the received print instruction. In the first modification, the controller 100 performs the measurement process when determining that at least one of particular requirements is satisfied, outside the print preparation period. Specifically, the controller 100 determines that at least one of the particular requirements is satisfied, when determining that a sheet jam has occurred, based on the pulse signal output from the rotary encoder 40 and the results of the detections by the sheet sensors 38 and 39. Then, the controller 100 performs the measurement process in advance of the printing process. Further, the controller 100 determines that at least one of the particular requirements is satisfied, when determining that a particular period of time has elapsed since the last execution of the measurement process. Then, the controller 100 performs the measurement process.

In the first modification, the controller 100 repeatedly performs the measurement process a plurality of times while changing the target velocity of the carriage 4. In other words, the measurement process is repeatedly performed a plurality of times corresponding to the plurality of different velocities settable as the target velocity, respectively. Thereby, it is possible to set an overshoot threshold for each of the plurality of settable target velocities of the carriage 4. The overshoot thresholds, obtained through the repeatedly-performed measurement processes, are stored into the non-volatile memory 104 in association with the plurality of settable target velocities, respectively.

In a procedure of recording an image on a single sheet P by repeatedly performing the recording process, a small amount of ink is discharged onto the sheet P during a particular number of first-performed recording processes among the repeatedly-performed recording processes. Hence, the sheet P is hard to deform and unlikely to rub against the head 5. Accordingly, the maximum one of the carriage velocities Vcr obtained during the particular number of first-performed recording processes is highly likely to be the maximum carriage velocity Vcr when "head-sheet rubbing is not occurring. Therefore, based on the maximum one of the carriage velocities Vcr obtained during the particular number of first-performed recording processes, an overshoot threshold for the following recording processes may be set. In addition, an abnormality might occur on the scale 21 due to some factor during a period of time from when the measurement process is performed until when the printing process is started. Thus, it is highly likely that the overshoot threshold set based on the maximum carriage velocity Vcr obtained during the particular number of first-performed recording processes is more appropriate than the overshoot threshold set based on the maximum carriage velocity Vcr obtained during the measurement process.

In view of the above, in the first modification, the overshoot threshold set through the measurement process is used for the first three recording processes (i.e., the first to third recording processes). Meanwhile, the overshoot threshold set based on the maximum one of the carriage velocities Vcr obtained during the first three recording processes is used for the following recording processes (i.e., the fourth or later recording processes).

Hereinafter, a sequence of operations by the printer 1 of the first modification will be described. As shown in FIG. 10, the controller 100 determines whether the controller 100 has received a print instruction from the external device 200 (A1). When determining that the controller 100 has received a print instruction from the external device 200 (A1: Yes), the controller 100 performs substantially the same process as performed in the aforementioned step S5 (A2). Afterward, the controller 100 extracts, from the non-volatile memory 104, an overshoot threshold associated with a target velocity of the carriage 4 for a printing process based on the received print instruction, and sets the extracted overshoot threshold as an overshoot threshold for a recording process to be performed (A3). Then, the controller 100 performs substantially the same processes as performed in the aforementioned steps S6 and S7 (A4 and A5).

After that, the controller 100 determines whether the obtained carriage velocity Vcr is less than the lower limit threshold (A6). When determining that the obtained carriage velocity Vcr is less than the lower limit threshold (A6: Yes), the controller 100 performs substantially the same processes as performed in the aforementioned steps S9 to S17 (A7 to A15). Meanwhile, when determining that the obtained carriage velocity Vcr is not less than the lower limit threshold (A6: No), the controller 100 performs substantially the same processes as performed in the aforementioned steps S18 to S20 (A7 to A18). In A18, when determining that the printing on the single sheet P is completed (A18: Yes), the controller 100 performs substantially the same processes as performed in the aforementioned steps S22 and S23 (A22 and A23).

Meanwhile, when determining that the printing on the single sheet P is not completed (A18: No), the controller 100 controls the conveyance motor 37 to convey the sheet P forward over a particular distance (A19). Thereafter, the controller 100 determines whether the recording process completed this time is the third recording process on the single sheet P (A20). When determining that the recording process completed this time is not the third recording process on the single sheet P (A20: No), the controller 100 goes back to A5 to perform a next recording process. Meanwhile, when determining that the recording process completed this time is the third recording process on the single sheet P (A20: Yes), the controller 100 sets an overshoot threshold used for the following recording processes (i.e., the fourth or later recording processes), based on the maximum one of the carriage velocities Vcr obtained during the first three recording processes (i.e., the first to third recording processes) (A21). Further, the controller 100 stores the overshoot threshold set at this time into the non-volatile memory 104 as an overshoot threshold corresponding to the target velocity of the carriage 4 for this printing process. Thereafter, the controller 100 goes back to A5 to perform a next recording process.

In A1, when determining that the controller 100 has not received a print instruction from the external device 200 (A1: No), as shown in FIG. 10A, the controller 100 determines whether at least one of the particular requirements is satisfied (A24). When determining that any of the particular requirements is not satisfied (A24: No), the controller 100 goes back to A1. Meanwhile, when determining that at least one of the particular requirements is satisfied (A24: Yes), the controller 100 performs the measurement process with each of the plurality of different velocities settable as the target velocity of the carriage 4 (A25). Specifically, while sequentially setting, as the target velocity of the carriage 4, each of the plurality of different velocities, the controller 100 repeatedly performs the measurement process to control the carriage motor 16 such that the carriage 4 moves with the set target velocity as a constant velocity and control the head 5 not to discharge ink from the nozzles 10. Thereafter, the controller 100 generates abnormal area information based on results of the detection by the sensor 22 during the measurement process in A25, and stores the generated abnormal area information into the non-volatile memory 104 (A26). Next, the controller 100 sets an overshoot threshold for each target velocity, based on the maximum one of the carriage velocities Vcr obtained during the measurement process with each target velocity in A25, and stores the overshoot threshold set for each target velocity into the non-volatile memory 104 (S27). Afterward, the controller 100 goes back to A1.

As described above, in the first modification, there is no need for the controller 100 to perform the measurement process during the print preparation period from when the controller 100 receives the print instruction until when the controller 100 starts the printing process. Therefore, it is possible to prevent the print preparation period from being extended by performing the measurement process during the print preparation period. Further, when the target velocity of the carriage 4 is changed, the behavior of the carriage velocity Vcr differs due to the change of the target velocity. In the first modification, the overshoot threshold is set for each target velocity of the carriage 4. Thus, it is possible to reduce a potential risk that the recording process might be unnecessarily interrupted even though "head-sheet rubbing" is not occurring.

In the first modification, the overshoot threshold set in the above measurement process may be used for every recording process to record the image on the single sheet P. Further, as described above, "head-sheet rubbing" is unlikely to occur during the particular number of first-performed recording processes. Therefore, there is no need to determine whether "head-sheet rubbing" is occurring, during the particular number of first-performed recording processes. In this case, based on the maximum one of the carriage velocities Vcr obtained during the particular number of first-performed recording processes, the controller 100 may set the overshoot threshold for the following recording processes. In other words, the controller 100 needs not set the overshoot threshold for the following recording processes on the basis of the maximum one of the carriage velocities Vcr obtained during the measurement process.

Subsequently, a second modification according to aspects of the present disclosure will be described with reference to FIG. 11. As mentioned before, when the carriage velocity Vcr is higher than the target velocity, as shown in FIGS. 6C, 7C, and 8C, the value of the electric current applied to the carriage motor 16 is smaller than the normal current value. Further, as the deviation of the carriage velocity Vcr from the target velocity increases, a difference between the value of the electric current applied to the carriage motor 16 and the normal current value increases.

Further, as described above, the overshooting amount by which the carriage velocity Vcr overshoots the target velocity under the feedback control after the carriage velocity Vcr is lower than the target velocity due to "head-sheet rubbing" is larger than the overshooting amount by which the carriage velocity Vcr overshoots the target velocity under the feedback control after the carriage velocity Vcr is lower than the target velocity due to the abnormality on the scale 21. Therefore, in the recording process, the electric current applied to the carriage motor 16 has the lowest value when the carriage velocity Vcr overshoots the target velocity due to "head-sheet rubbing."

In view of the above, in the second modification, an undershoot threshold is set as a particular threshold lower than the normal current value. In this case, when the current value detected by the current sensor 55 is lower than the undershoot threshold, the controller 100 determines that "head-sheet rubbing" is occurring, and interrupts the recording process in execution.

In the following description, a sequence of operations by the printer 1 of the second modification will be described. As shown in FIG. 11, first, the controller 100 determines whether the controller 100 has received a print instruction from the external device 200 (B1). When determining that the controller 100 has not received a print instruction from the external device 200 (B1: No), the controller 100 repeatedly performs B1 until the controller 100 receives a print instruction from the external device 200. Meanwhile, when determining that the controller 100 has received a print instruction from the external device 200 (B1: Yes), the controller 100 performs substantially the same process as performed in the aforementioned step S2. Afterward, the controller 100 sets the undershoot threshold based on the minimum one of the current values detected by the current sensor 55 during the measurement process (B3). In the second modification, for instance, in view of influences of noises, the undershoot threshold may be set to a value several percent lower than the minimum current value. Next, the controller 100 performs substantially the same processes as performed in the aforementioned steps S5 to S7 (B4 to B6).

Then, the controller 100 determines whether the current value detected by the current sensor 55 is lower than the undershoot threshold (B7). When determining that the current value detected by the current sensor 55 is lower than the undershoot threshold (B7: Yes), the controller 100 determines that "head-sheet rubbing" is occurring, and performs the substantially the same processes as performed in the aforementioned steps S15 to S17 (B8 to B10). Thereafter, the controller 100 goes back to B5. Meanwhile, when determining that the current value detected by the current sensor 55 is not lower than the undershoot threshold (B7: No), the controller 100 determines that "head-sheet rubbing" is not occurring, and performs the substantially the same processes as performed in the aforementioned steps S18 to S23 (B11 to B16).

In the second modification, as described above, during execution of the recording process, when the current value detected by the current sensor 55 is lower than the undershoot threshold, the controller 100 determines that "head-sheet rubbing" is occurring, and interrupts the recording process in execution. Thereby, it is possible to prevent the head from being damaged by "head-sheet rubbing" and avoid unnecessary interruption of the recording process.

As mentioned before, when the carriage velocity Vcr is lower than the target velocity, the value of the electric current applied to the carriage motor 16 is larger than the normal current value. Accordingly, when the current value detected by the current sensor 55 while the controller 100 is controlling the carriage motor 16 is more than a particular threshold (hereinafter referred to as an "upper limit threshold") in a period of time during which the detecting position of the sensor 22 is out of the abnormal area, the controller 100 is allowed to determine that "head-sheet rubbing" is occurring. Accordingly, when the current value detected by the current sensor 55 is more than the upper limit threshold in the period of time during which the detecting position of the sensor 22 is out of the abnormal area, the controller 100 determines that "head-sheet rubbing" is occurring, and interrupts the recording process in execution. Meanwhile, when the current value detected by the current sensor 55 is more than the upper limit threshold in a period of time during which the detecting position of the sensor 22 is within the abnormal area, the controller 100 is not allowed to determine that "head-sheet rubbing" is occurring, at this time. Thus, in this case, the controller 100 does not interrupt the recording process. Then, when the current value detected by the current sensor 55 is lower than the undershoot threshold in a period of time during which the detecting position of the sensor 22 is within the particular area, the controller 100 is allowed to determine that "head-sheet rubbing" is occurring and to interrupt the recording process in execution.

Hereinafter, other modifications according to aspects of the present disclosure will be described.

In the aforementioned illustrative embodiment, the controller 100 stops the carriage 4 to interrupt the recording process. Nonetheless, for instance, the controller 100 may control the carriage motor 16 to move the carriage 4 in an opposite direction of the moving direction in which the carriage 4 moves in the recording process, to interrupt the recording process. It is noted that the head 5 and the sheet P are not in contact with each other until "head-sheet rubbing" occurs. Hence, even though the carriage 4 is moved in the opposite direction of the moving direction in which the carriage 4 moves in the recording process, the head 5 is unlikely to rub against the sheet P. Thus, even though the controller 100 controls the carriage motor 16 to move the carriage 4 in the opposite direction of the moving direction in which the carriage 4 moves in the recording process, the head 5 is unlikely to be damaged due to "head-sheet rubbing."

Further, in the aforementioned illustrative embodiment, the abnormal area information stored in the non-volatile memory 104 has been generated based on the results of the detection by the sensor 22 during the measurement process. Nonetheless, the abnormal area information stored in the non-volatile memory 104 may have been input via the touch panel 99 by the user who has visually recognized the abnormality on the scale 21. Further, if positions on the scale 21 where abnormalities are likely to occur with time are previously determined, abnormal area information associated with each usage period for the printer 1 may be previously stored in the non-volatile memory 104. Then, before beginning to perform the recording processes, the controller 100 may extract, from the non-volatile memory 104, the abnormal area information associated with an actual usage period during which the printer 1 has been used until the present time.

Further, the controller 100 may be configured to interrupt the recording process in execution, only when the carriage velocity Vcr exceeds the overshoot threshold during execution of the recording process, regardless of where the detecting position of the sensor 22 is on the scale 21. Further, the overshoot threshold may be a fixed value.

In the aforementioned illustrative embodiment, the linear encoder 7 is a transmission type linear encoder. Nonetheless, the linear encoder 7 may be a reflection type linear encoder. In this case, the scale 21 may include reflection regions instead of the aforementioned transmissive regions 21*a*. Further, the scale 21 may include non-reflection regions instead of the aforementioned non-transmissive regions 21*b*. Furthermore, in this case, the light emitting element 26 and the light receiving element 27 may be disposed together in front of or in the rear of the scale 21, such that the sensor 22 outputs substantially the same pulse signal as exemplified in the aforementioned illustrative embodiment. In a further instance, an encoder (e.g., a magnetic encoder) other than optical encoders may be employed instead of the linear encoder 7. In this case, the scale 21 may include non-magnetized regions instead of the aforementioned transmissive regions 21*a*. Further, the scale 21 may include magnetized regions instead of the aforementioned non-transmissive regions 21*b*.

Further, instead of the linear encoder 7, any encoder may be employed to obtain the carriage velocity Vcr, as long as the encoder includes a sensor configured to move relative to a scale, along with movement of the carriage 4 along the scanning direction. For instance, a rotary encoder may be attached to a rotational shaft of the carriage motor 16. In this case, the carriage velocity Vcr may be obtained based on results of detection by the rotary encoder. The rotary encoder may include a disk-shaped scale with reference marks formed at regular intervals in a circumferential direction of the scale, and a sensor configured to detect the reference marks formed on the scale. The sensor may detect the reference marks on the scale rotating during the movement of the carriage 4 and output a detection signal as detection results to the controller 100. The controller 100 may obtain the carriage velocity Vcr based on the detection results. In substantially the same manner as the scale 21 of the linear encoder 7, the scale of the rotary encoder might be stained or damaged to have abnormalities thereon.

In the aforementioned illustrative embodiment, the controller 100 obtains the carriage velocity Vcr based on the results of the detection by the sensor 22. Nonetheless, the controller 100 may obtain not the carriage velocity Vcr but a velocity parameter related to the carriage velocity Vcr. For instance, the controller 100 may obtain, as the velocity parameter, the clock number CK counted during the V1 maintenance period, instead of calculating the carriage velocity Vcr. In this case, the velocity parameter increases as the velocity of the carriage 4 decreases.

In the aforementioned illustrative embodiment, when determining that "head-sheet rubbing" is occurring, the controller 100 changes the ink discharge data, thereby reducing the amount of ink to be discharged onto each single sheet P. Nonetheless, for instance, the controller 100 may adjust a driving voltage to be applied to each driving element included in the actuator of the head 5, thereby reducing the amount of ink to be discharged onto each single sheet P.

In the aforementioned illustrative embodiment, the controller 100 performs the measurement process when determining the sheet P is not positioned in the opposed area A. Nonetheless, the controller 100 may perform the measurement process even when determining the sheet P is positioned in the opposed area A. Even though the sheet P is positioned in the opposed area A, since the nozzles 10 are controlled not to discharge ink during the measurement process, the head 5 is unlikely to contact the sheet P positioned in the opposed area A. Thus, even when the sheet P is positioned in the opposed area A, it is possible to accurately set the abnormal area information and the overshoot threshold.

In the aforementioned illustrative embodiment, aspects of the present disclosure are applied to the printer 1 configured to record an image on a sheet P by discharging ink onto the sheet P from the nozzles 10. Nonetheless, aspects of the present disclosure may be applied to a printer configured to record an image on a recording medium other than the sheet P by discharging liquid onto the recording medium. Specifically, for instance, aspects of the present disclosure may be applied to a printer configured to record an image on a recording medium by alternately and repeatedly performing an operation of discharging ink from nozzles while moving a carriage with a head mounted thereon in a scanning direction and an operation of moving a stage with the recording medium placed thereon in a conveyance direction. In this case, examples of the recording medium may include, but are not limited to, T shirts and sheets for outdoor advertisement. In another instance, aspects of the present disclosure may be applied to a printer configured to record an image by discharging liquid onto a wiring board. In this case, the liquid may be material for a wiring pattern other than ink. In a further instance, aspects of the present disclosure may be applied to a printer configured to record an image by discharging ink onto a case for a mobile terminal such as a smartphone, a piece of cardboard, and a piece of resin.

The following shows examples of associations between elements exemplified in the aforementioned illustrative embodiment and modifications and elements according to aspects of the present disclosure. The inkjet printer 1 may be an example of a "printer" according to aspects of the present disclosure. The head 5 may be an example of a "head" according to aspects of the present disclosure. The nozzles 10 may be an example of "nozzles" according to aspects of the present disclosure. The carriage 4 may be an example of a "carriage" according to aspects of the present disclosure. The carriage motor 16 may be an example of a "carriage motor" according to aspects of the present disclosure. The linear encoder 7 may be an example of an "encoder" according to aspects of the present disclosure. Nonetheless, instead of the linear encoder 7, a rotary encoder may be employed as the "encoder" according to aspects of the present disclosure. The scale 21 may be an example of a "scale" according to aspects of the present disclosure. The non-transmissive regions 21*b* or the transmissive regions 21*a* may be an example of "reference marks" according to aspects of the present disclosure. The controller 100 may be an example of a "controller" according to aspects of the present disclosure. The CPU 101 may be an example of a "processor" according to aspects of the present disclosure. The ROM 102 storing the programs 102*a* may be an example of a "non-transitory computer-readable medium storing computer-readable instructions" according to aspects of the present disclosure. The non-volatile memory 104 may be an example of a "memory" according to aspects of the present disclosure. The current sensor 55 may be an example of a "current sensor" according to aspects of the present disclosure.

What is claimed is:

1. A printer comprising:

a head having nozzles configured to discharge liquid therefrom;

a carriage with the head mounted thereon;

a carriage motor configured to, when driven, cause the carriage to move along a scanning direction;

an encoder comprising:

a scale having reference marks formed thereon, the reference marks being arranged at regular intervals along a particular direction; and a sensor configured to detect the reference marks formed on the scale while moving relative to the scale along the particular direction along with movement of the carriage along the scanning direction; and a controller configured to:

perform reference mark detection to detect the reference marks by the sensor while controlling the head to not discharge the liquid from the nozzles and performing feedback control of the carriage motor based on first velocity information in such a manner that the carriage moves at a target velocity along the scanning direction, the first velocity information representing a carriage velocity as a velocity of the carriage based on results of detecting the reference marks by the sensor;

obtain the first velocity information based on the results of detecting the reference marks by the sensor during the reference mark detection; and set an overshoot threshold based on a maximum value of the carriage velocity represented by the first velocity information obtained during the reference mark detection performed while liquid is not discharged from the nozzles, wherein the overshoot threshold is set higher than a first overshoot velocity of the carriage that overshoots the target velocity under the feedback control after the carriage velocity becomes lower than the target velocity due to head-sheet rubbing, the first overshoot velocity being higher than a second overshoot velocity of the carriage that overshoots the target velocity under the feedback control after the carriage velocity becomes lower than the target velocity due to abnormality on the scale;

perform liquid discharging to control the head to discharge the liquid from the nozzles toward a recording medium while performing further feedback control of the carriage motor based on second velocity information obtained during the liquid discharging in such a manner that the carriage moves at the target velocity along the scanning direction;

during the liquid discharging, determine whether the carriage velocity represented by the second velocity information obtained during the liquid discharging is higher than the overshoot threshold set based on the first velocity information obtained during the reference mark detection without liquid discharged, the overshoot threshold being higher than the target velocity; and interrupt the liquid discharging, when determining that the carriage velocity represented by the second velocity information is higher than the overshoot threshold during the liquid discharging.

2. The printer according to claim 1, wherein the controller is further configured to:

repeatedly perform the liquid discharging, the repeatedly-performed liquid discharging including a plurality of individual liquid discharging processes, the plurality of individual liquid discharging processes including a particular number of earlier-performed liquid discharging processes from a first liquid discharging process to an N-th liquid discharging process, N being the particular number;

obtain the second velocity information based on the results of detecting the reference marks by the sensor during the particular number of earlier-performed liquid discharging processes among the plurality of individual liquid discharging processes; and set the overshoot threshold for one or more later-performed recording processes following the particular number of earlier-performed liquid discharging processes, based on a maximum value of the carriage velocity represented by the second velocity information obtained during the particular number of earlier-performed liquid discharging processes.

3. The printer according to claim 1, further comprising a memory storing abnormal area information regarding an abnormal area on the scale, wherein the controller is further configured to:

interrupt the liquid discharging, when the carriage velocity represented by the second velocity information is lower than a lower limit threshold while a detecting position of the sensor on the scale is outside the abnormal area represented by the abnormal area information stored in the memory, the lower limit threshold being lower than the target velocity; and interrupt the liquid discharging, when the carriage velocity is lower than the lower limit threshold while the detecting position on the scale is within the abnormal area, and thereafter, the carriage velocity is higher than the overshoot threshold while the detecting position on the scale is within a particular area including the abnormal area.

4. The printer according to claim 3, wherein the particular area includes the abnormal area and an adjoining area, the adjoining area has a particular width in a specific direction and is adjacent to a downstream end of the abnormal area in the specific direction, and the specific direction is one of both directions along the scanning direction along which the carriage reciprocates and is a direction in which the carriage moves during the liquid discharging.

5. The printer according to claim 3, wherein the controller is further configured to:

generate the abnormal area information, based on the results of detecting the reference marks by the sensor during the reference mark detection, and store the generated abnormal area information into the memory.

6. The printer according to claim 5, wherein the controller is further configured to set, as the abnormal area, an area having an abnormality that causes the carriage velocity to be equal to or less than a particular threshold during the reference mark detection, the particular threshold being lower than the target velocity.

7. The printer according to claim 1, having a plurality of different velocities settable as the target velocity, wherein the controller is further configured to:

set each of the plurality of different velocities as the target velocity; and set the overshoot threshold for each velocity set as the target velocity.

8. The printer according to claim 1, wherein the scale has the reference marks formed thereon at regular intervals along the scanning direction, and the sensor is mounted on the carriage.

9. The printer according to claim 1, wherein the controller comprises:

a processor; and a non-transitory computer-readable medium storing computer-readable instructions configured to, when executed by the processor, cause the controller to:

perform the liquid discharging; and interrupt the liquid discharging when the carriage velocity is higher than the overshoot threshold during the liquid discharging.

10. The printer according to claim 1, wherein the reference marks are arranged at regular intervals along the scanning direction.

* * * * *